US005362609A

United States Patent [19]

Kuwae et al.

[11] Patent Number: 5,362,609

[45] Date of Patent: Nov. 8, 1994

[54] STABILIZING SOLUTION FOR LIGHT-SENSITIVE SILVER HALIDE COLOR PHOTOGRAPHIC MATERIAL, AND PROCESSING METHOD MAKING USE OF THE STABILIZING SOLUTION

[75] Inventors: Kenji Kuwae; Hiroaki Kobayashi; Moeko Hagiwara, all of Tokyo, Japan

[73] Assignee: Konica Corporation, Tokyo, Japan

[21] Appl. No.: 187,801

[22] Filed: Jan. 26, 1994

Related U.S. Application Data

[63] Continuation of Ser. No. 932,259, Aug. 19, 1992, abandoned.

[30] Foreign Application Priority Data

Sep. 25, 1991 [JP] Japan ..... 3-245912

[51] Int. Cl.[5] ..... G03C 5/39

[52] U.S. Cl. ..... 430/372; 430/428; 430/429

[58] Field of Search ..... 430/372, 428, 429, 463

[56] References Cited

U.S. PATENT DOCUMENTS

| | | | |
|---|---|---|---|
| 4,760,015 | 7/1988 | Berthold et al. | 430/428 |
| 4,849,333 | 7/1989 | Fujita | 430/463 |
| 5,110,716 | 5/1992 | Kuse et al. | 430/372 |
| 5,188,925 | 2/1993 | Hagiwara et al. | 430/428 |

FOREIGN PATENT DOCUMENTS

| | | | |
|---|---|---|---|
| 0506349 | 9/1992 | European Pat. Off. . | |
| 8542 | 1/1982 | Japan | 430/463 |
| 97530 | 6/1982 | Japan | 430/463 |
| 249156 | 10/1987 | Japan | 430/463 |

*Primary Examiner*—Hoa Van Le

*Attorney, Agent, or Firm*—Frishauf, Holtz, Goodman & Woodward

[57] ABSTRACT

Disclosed is a stabilizing solution for a light-sensitive silver halide color photographic material, comprises a compound represented by the following Formula F, and has a pH of from 7.5 to 10.0;

Formula F:

wherein Z represents a group of atoms necessary to form a substituted or unsubstituted cyclic hydrocarbon or heterocyclic ring, X represents an aldehyde group, wherein $R_1$ and $R_2$ each represent a lower alkyl group. The stabilizing solution and the processing method for a light-sensitive silver halide color photographic material according to this invention, can provide a processing technique that can achieve a superior stability of dye images, can better prevent backside deposits, can promise superior solution stability, and can better prevent yellow staining.

10 Claims, No Drawings

STABILIZING SOLUTION FOR LIGHT-SENSITIVE SILVER HALIDE COLOR PHOTOGRAPHIC MATERIAL, AND PROCESSING METHOD MAKING USE OF THE STABILIZING SOLUTION

This application is a continuation of application Ser. No. 07/932,259, filed Aug. 19, 1992 (abandoned).

FIELD OF THE INVENTION

The present invention relates to a stabilizing solution for light-sensitive silver halide color photographic materials, and a processing method making use of the stabilizing solution. More particularly, it is concerned with a processing technique that can keep stable dye images without regard to variation in processing quantity, and can promise superior solution stability.

BACKGROUND OF THE INVENTION

In the processing of light-sensitive color photographic materials for photographing as typified by light-sensitive photographic materials in which the silver halide comprises silver iodobromide, it has been hitherto common to use in a final processing step subsequent to a washing bath a stabilizing solution containing formaldehyde.

The formaldehyde used in the above stabilizing solution is effective for preventing changes in physical properties of light-sensitive color photographic materials, in particular, changes in gradation that may occur when scratches are produced on the surfaces of light-sensitive color photographic materials or light-sensitive photographic materials are gradually hardened with time. The formaldehyde is also known to be effective against the deterioration of dye images that may be caused by an unreacted coupler remaining in light-sensitive color photographic materials.

However, the formaldehyde added in the stabilizing solution for the purpose of, e.g., stabilizing dye images may form an adduct together with sulfite ions that adhere to a light-sensitive material and are brought into it from a forebath (a processing solution having a fixing ability), not only resulting in a decrease in the originally intended dye image stabilizing effect, but also causing a promotion of sulfiding disadvantageously.

To solve these problems, it has been proposed to use an alkanol amine as disclosed in U.S. Pat. No. 4,786,583. Use of the alkanol amine, however, tends to have an ill influence to the prevention of yellow staining at a non-image portion, and also can not be said to bring about a satisfactory effect for the prevention of sulfiding.

Meanwhile, in U.S.A., CIIT (Chemical Industry Institute of Toxicology) has reported that formaldehyde caused nasal foramen cancer in rats as a result of administration of 15 ppm of formaldehyde. NIOSH (National Institute for Occupational Safety and Health) and ACGIH (American Conference of Governmental Industrial Hygienists) also state that there is a possibility of producing a cancer. In Europe also, use of formaldehyde is strongly regulated. In West Germany, formaldehyde has been so regulated since 10 years ago as to be in a concentration of 0.1 ppm or less in residential areas.

In Japan also, in token of the harmfulness of formaldehyde, there have been legislations concerning poisons and powerful drags because of its stimulative action to the mucous membrane, regulations to organic solvent toxication, according to the Specified Chemical Substances Troubles Preventive Rule of the Occupational Safety and Health Law, regulations on household utensils, regulations relating to fibers and veneer boards, and also formaldehyde regulations put into operation as from 1975 with regard to undershirts and baby's clothing. Thus, people have longed for a technique by which the formaldehyde can be decreased.

As techniques of making substantially zero, or decreasing, the content of formaldehyde in stabilizing solutions, Japanese Patent Publications Open to Public Inspection [hereinafter referred to as Japanese Patent O.P.I. Publication(s)] No. 27742/1987 and No. 151538/1986 disclose use of hexahydrotriazine compounds and U.S. Pat. No. 4,859,574 discloses use of N-methylol compounds, as means for achieving the above objects.

The hexahydrotriazine compounds can prevent dyes from being discolored in an environment of high temperature and high humidity even if formaldehyde has been made substantially zero, but have the problem that they are not effective in an environment of low humidity, e.g., a relative humidity of 20% or less. They have also have a problem in the storage stability of stabilizing solutions although not so serious as formaldehyde, in particular, the problem that the sulfiding tends to occur. It has been made clear that the storage stability is particularly questioned when a stabilizing solution is used in processing over a long period of time, when used in processing in a small quantity, or when used in a low replenishing rate.

As for the N-methylol compounds, when used as substitute compounds of formaldehyde, they have the problems that the effect of preventing discoloration of dyes and the storage stability of stabilizing solutions can not be satisfactory and that an attempt to prevent discoloration of dyes results in a great deterioration of the storage stability of stabilizing solutions.

There is also a disclosure of a method in which hexamethylenetetramine compounds are used in stabilizing solutions, which, however, like the hexahydrotriazine compounds, are disadvantageous in that they are not well effective for preventing discoloration of dyes in an environment of low humidity.

In recent years, there is an increase in photofinishing laboratories that handle processing in a small quantity, and the storage stability of stabilizing solutions has come into question. In particular, because of the low-replenishment processing that has come to the front for the purpose of lowering environmental pollution, it is difficult for any conventional techniques to cope with this problem.

SUMMARY OF THE INVENTION

Accordingly, an object of the present invention is to provide a stabilizing solution for light-sensitive silver halide color photographic materials, and a processing method, that firstly can prevent discoloration or fading of dyes in an environment of low humidity even when substantially no formaldehyde is contained in the stabilizing solution, secondly can keep stable dye images without regard to variation in processing quantity, and thirdly do not tend to cause sulfiding.

To achieve the above object, the present inventors made extensive studies, and as a result have accomplished the present invention.

The stabilizing solution for a light-sensitive silver halide color photographic material according to the present invention comprises a compound represented by the following Formula F, and has a pH of from 7.5 to 10.0.

Formula F:

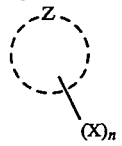

wherein Z represents a group of atoms necessary to complete a substituted or unsubstituted carbon ring or substituted or unsubstituted heterocyclic ring; and X represents an aldehyde group,

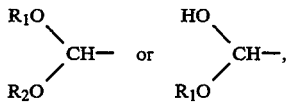

wherein $R_1$ and $R_2$ each represent a lower alkyl group; and n represents an integer of 1 to 3. The method of processing a light-sensitive silver halide color photographic material according to the present invention comprises processing a light-sensitive silver halide color photographic material by the use of at least one of a processing solution having a bleaching ability and a processing solution having a fixing ability, and thereafter processing it by the use of the stabilizing solution described above.

As a preferred embodiment of the present invention, in the above stabilizing solution for a light-sensitive silver halide color photographic material and the above processing method, the above Z in Formula F represents an aromatic carbon ring having a substituent or a heterocyclic ring having a substituent; the stabilizing solution may contain substantially no formaldehyde; the stabilizing solution may contain a water-soluble surface active agent; and/or the stabilizing solution may contain an antifungal agent.

As another preferred embodiment of the present invention, the substitutent of the above Z is an aldehyde group, a hydroxyl group, an alkyl group, an aralkyl group, an alkoxyl group, a halogen atom, a nitro group, a sulfo group, a carboxyl group, an amino group, a hydroxyalkyl group, an aryl group, a cyano group, an aryloxy group, an acyloxy group, an acylamino group, a sulfonamide group, a sulfamoyl group, a carbamoyl group or a sulfonyl group.

DETAILED DESCRIPTION OF THE INVENTION

Processing steps in the processing method making use of the stabilizing solution of the present invention may include the following, which are by no means limited to these.

(1) Color developing→bleach-fixing→washing→stabilizing
(2) Color developing→bleaching→fixing→washing→stabilizing
(3) Color developing→bleaching→bleach-fixing→washing→stabilizing
(4) Color developing→bleach-fixing→fixing→washing→stabilizing
(5) Color developing→bleach-fixing→bleach-fixing→washing→stabilizing
(6) Color developing→fixing→bleach-fixing→washing→stabilizing
(7) Color developing→bleaching→bleach-fixing→fixing→washing→stabilizing
(8) Black and white developing→washing→reversal→color developing→washing→compensating→bleaching→fixing→washing→stabilizing
(9) Black and white developing→washing→reversal→color developing→washing→compensating→bleach-fixing→washing→stabilizing
(10) Color developing→bleach→fixing→stabilizing
(11) Color developing→bleaching→fixing→stabilizing
(12) Color developing→bleaching→bleach-fixing→stabilizing
(13) Color developing→bleach-fixing→fixing→stabilizing
(14) Color developing→bleach-fixing→bleach-fixing→stabilizing
(15) Color developing→fixing→bleach-fixing→stabilizing
(16) Color developing→bleaching→bleach-fixing→fixing→stabilizing
(17) Black and white developing→washing→reversal→color developing→washing→compensating→bleaching→fixing→stabilizing
(18) Black and white developing→washing→reversal→color developing→washing→compensating→bleach-fixing→stabilizing In the present invention, the processing steps may preferably be those of (1), (2), (8), (10), (11) and (17), more preferably those of (2), (8), (11) and (17), and particularly preferably those of (11).

In other words, a most preferred embodiment of the processing method in the present invention is a method in which after processing with a processing solution having a bleaching ability and/or a processing solution having a fixing ability, preferably after processing with a processing solution having a fixing ability, processing with the stabilizing solution is immediately carried out. In the present invention, the processing solution having a bleaching ability refers to, for example, a bleaching solution or a bleach-fixing solution in the above processing steps. The processing solution having a fixing ability also refers to, for example, a fixing solution or a bleach-fixing solution.

The compound represented by Formula F used in the present invention will be detailed below.

In Formula F, Z represents a group of atoms necessary to complete a substituted or unsubstituted carbon ring or substituted or unsubstituted heterocyclic ring. The carbon ring and heterocyclic ring may each be a single ring or a condensed ring. Z may preferably be an aromatic carbon ring having a substituent or a heterocyclic ring having a substituent. The substituent on Z may preferably be an aldehyde group, a hydroxyl group, an alkyl group as exemplified by methyl, ethyl, methoxyethyl, benzyl, carboxymethyl or sulfopropyl, an aralkyl group, an alkoxyl group as exemplified by methoxy, ethoxy or methoxyethoxy, a halogen atom, a nitro group, a sulfo group, a carboxyl group, an amino group as exemplified by N,N-dimethylamino, N-ethylamino or N-phenylamino, a hydroxyalkyl group, an aryl group as exemplified by phenyl or p-methoxyphenyl, a cyano group, an aryloxy group as exemplified by phenoxy or p-carboxyphenyl, an acyloxy group, an acylamino group, a sulfonamide group, a sulfamoyl group as exemplified by N-ethylsulfamoyl or N,N-dimethylsulfamoyl, a carbamoyl group as exemplified by carbamoyl, N-methylcarbamoyl or N,N-tetramethylenecarbamoyl, or a sulfonyl group as exemplified by methanesulfonyl, ethanesulfonyl, benzenesulfonyl or p-toluenesulfonyl.

The carbon ring represented by Z may preferably be a benzene ring. The heterocyclic ring represented by Z may preferably include heterocyclic rings of 5 or 6 members. The rings of 5 members are exemplified by thiophene, pyrrole, furan, thiazole, imidazole, pyrazole, succinimide, triazole or tetrazola. The rings of 6 embers are exemplified by pyridine, pyrimidine, triazine or thiadiazine. The condensed ring may include naphthalene, benzofuran, indole, thionaphthalene, benzimidazole, benzotriazole and quinoline.

Exemplary compounds of the compound represented by Formula F are shown below.

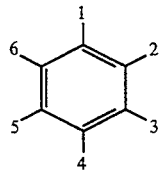

Structural formulas of Exemplary compounds F-1 to F-48 are each completed by inserting the following substituents or atoms 1 to 6 to the positions 1 to 6 of the above formula.

| No. | 1 | 2 | 3 | 4 | 5 | 6 |
|---|---|---|---|---|---|---|
| (F-1) | —CHO | H | H | H | H | H |
| (F-2) | —CHO | H | H | —OH | H | H |
| (F-3) | —CHO | H | —OH | H | H | H |
| (F-4) | —CHO | —OH | H | H | H | H |
| (F-5) | —CHO | —OH | H | —OH | H | H |
| (F-6) | —CHO | H | —OH | H | —OH | H |
| (F-7) | —CHO | —OH | —OH | H | H | H |
| (F-8) | —CHO | H | —CHO | H | —OH | H |
| (F-9) | —CHO | H | —CHO | H | H | —OH |
| (F-10) | —CHO | —OH | —CHO | H | H | H |
| (F-11) | —CHO | H | —CHO | H | —CHO | H |
| (F-12) | —CHO | —OH | —CHO | H | —CHO | H |
| (F-13) | $—CH(OCH_3)_2$ | H | —OH | H | H | H |
| (F-14) | $—CH(OCH_3)_2$ | H | H | —OH | H | H |
| (F-15) | $—CH(OCH_3)_2$ | H | —OH | H | —OH | H |
| (F-16) | —CHO | H | $—NO_2$ | H | H | H |
| (F-17) | —CHO | H | H | $—NO_2$ | H | H |
| (F-18) | —CHO | $—NO_2$ | H | H | H | H |
| (F-19) | —CHO | H | $—NO_2$ | H | $—NO_2$ | H |
| (F-20) | —CHO | H | H | $—OCH_3$ | H | H |
| (F-21) | —CHO | H | $—OCH_3$ | H | —OH | H |
| (F-22) | —CHO | H | —OH | $—OCH_3$ | H | H |
| (F-23) | —CHO | H | $—OCH_3$ | —OH | H | H |
| (F-24) | —CHO | H | —OH | $—OCH_3$ | —OH | H |
| (F-25) | —CHO | H | Cl | H | H | H |
| (F-26) | —CHO | H | H | Cl | H | H |
| (F-27) | —CHO | H | Cl | H | Cl | H |
| (F-28) | —CHO | H | —COOH | —COOH | H | H |
| (F-29) | —CHO | H | Br | H | H | H |
| (F-30) | —CHO | H | H | Br | H | H |
| (F-31) | —CHO | H | —OH | $—SO_3H$ | H | H |
| (F-32) | —CHO | H | H | $—NH_2$ | H | H |
| (F-33) | —CHO | H | H | $—N(CH_3)_2$ | H | H |
| (F-34) | —CHO | H | H | $—N(C_2H_5)_2$ | H | H |
| (F-35) | —CHO | H | H | $—CONH_2$ | H | H |
| (F-36) | —CHO | H | H | $—SO_2NH_2$ | H | H |
| (F-37) | —CHO | H | H | $—SO_3H$ | H | H |
| (F-38) | —CHO | H | H | —CN | H | H |
| (F-39) | —CHO | H | H | $—COOCH_3$ | H | H |
| (F-40) | —CHO | H | H | —COOH | H | H |
| (F-41) | —CHO | H | $—SO_3H$ | H | H | H |
| (F-42) | —CHO | H | —COOH | H | H | H |
| (F-43) | —CHO | H | —CN | H | H | H |
| (F-44) | —CHO | H | $—COOCH_3$ | H | H | H |
| (F-45) | —CHO | H | $—CONH_2$ | H | H | H |
| (F-46) | —CH(OH)(OCH3) | H | —OH | H | H | H |
| (F-47) | —CH(OH)(OCH3) | H | H | —OH | H | H |
| (F-48) | —CHO | H | —OH | $—CH_3$ | H | H |
| (F-49) | | | | | | |
| (F-50) | | | | | | |

-continued
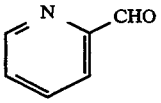
(F-51)
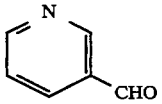
(F-52)
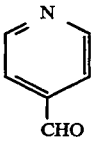
(F-53)
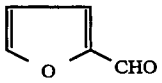
(F-54)
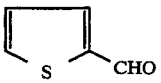
(F-55)
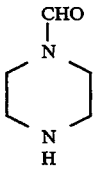
(F-56)
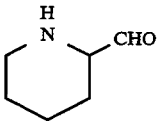
(F-57)
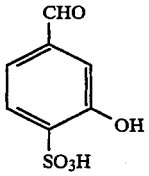
(F-58)
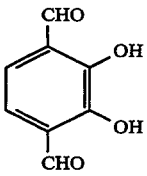
(F-59)
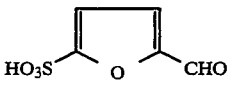
(F-60)
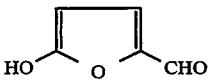
(F-61)
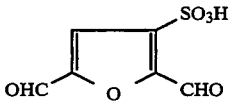
(F-62)
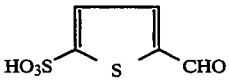
(F-63)
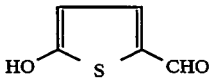
(F-64)
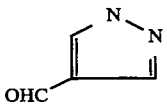
(F-65)
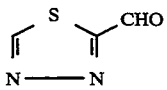
(F-66)
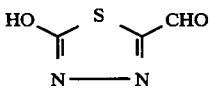
(F-67)
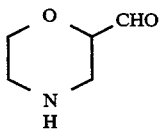
(F-68)

-continued
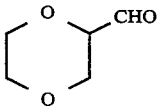
(F-69)
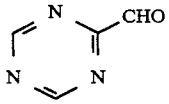
(F-70)
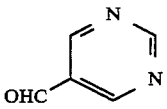
(F-71)
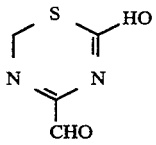
(F-72)
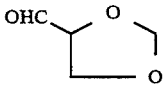
(F-73)
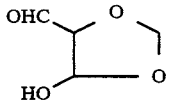
(F-74)
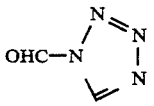
(F-75)
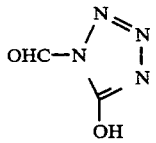
(F-76)
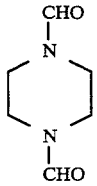
(F-77)
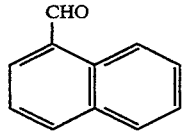
(F-78)
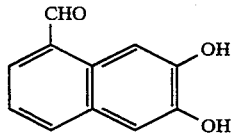
(F-79)
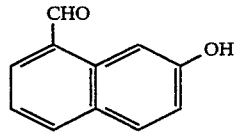
(F-80)
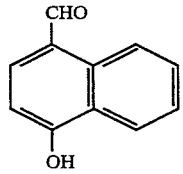
(F-81)
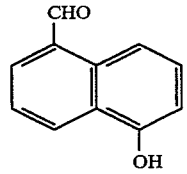
(F-82)
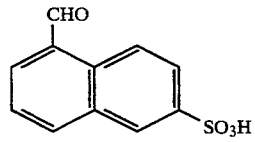
(F-83)
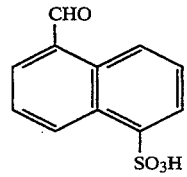
(F-84)

-continued

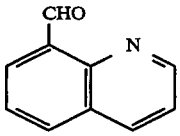

(F-85)

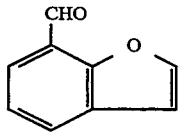

(F-86)

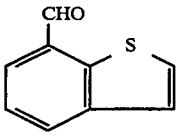

(F-87)

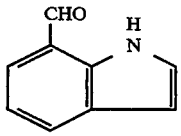

(F-88)

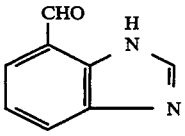

(F-89)

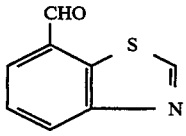

(F-90)

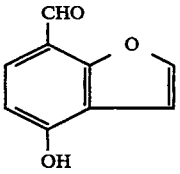

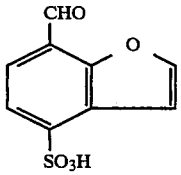

The compound represented by Formula F is readily commercially available.

The compound represented by Formula F is contained in the stabilizing solution for light-sensitive silver halide color photographic materials. It may also be contained in i) a processing solution used in a forebath of the processing bath having a bleaching ability, ii) the processing solution having a bleaching ability and iii) the processing solution having a fixing ability, so long as the effect of the present invention is not damaged.

The compound represented by Formula F may preferably be added in an amount of from 0.05 to 20 g, more preferably from 0.1 to 15 g, and particularly preferably from 0.5 to 10 g, per liter of the stabilizing solution.

The compound represented by Formula F is characterized by giving a good image storage stability particularly in an environment of low humidity, compared with any known formaldehyde substitute compounds.

The stabilizing solution of the present invention has a pH in the range of from 7.5 to 10.0, and may particularly preferably have a pH in the range of from 8.0 to 9.5.

If the pH is in the region lower than the above range, the stabilizing solution not only may be less effective for stabilizing dye images, but also tends to become ineffectual with time or cause sulfiding due to components of a fixing solution, so that the stabilizing solution may have a greatly poor storage stability. If the pH is in the region higher than the above range, the stabilizing solution may become less effective for stabilizing dye images with time, and, as a particularly serious problem, may disadvantageously cause yellow stain on light-sensitive materials having been processed. This yellow stain is found to be more increase with time.

Hence, the stabilizing solution of the present invention must be in the above pH range.

In the stabilizing solution of the present invention, it is preferrable to use a surface active agent, in particular, a water-soluble surface active agent. As the water-soluble surface active agent, at least one compound selected from a compound represented by the following Formula SI, a compound represented by the following SII and a water-soluble organic siloxane compound may particularly preferably be used. Formula SI:

$$R^1—X—(E^1—)_{l1}—(—E^2—)_{m1}—(—E^3—)_{n1}—R^2$$

In Formula SI, $R^1$ represents a hydrogen atom, an aliphatic group or an acyl group, and $R^2$ represents a hydrogen atom or an aliphatic group. $E^1$ represents an ethyleneoxy group, $E^2$, a propyleneoxy group or a trimethyleneoxy group, $E^3$ represents an ethyleneoxy group, and X represents an oxygen atom or an $—R^3N—$ group, wherein $R^3$ represents an aliphatic group, a hydrogen atom or $(E^1—)_{l2}—(—E^2—)_{m2}—(—E^3—)_{n2}—R^4$, wherein $R^4$ represents a hydrogen atom or an aliphatic group. l1, l2, m1, m2, n1, n2 each represent an integer of 0 to 300. Formula SII:

$$A_2—O—(—B—)_m—(—C—)_n—X_1$$

In Formula SII, $A_2$ represents a monovalent organic group as exemplified by an alkyl group having 6 to 50 carbon atoms, and preferably 6 to 35 carbon atoms, including groups such as hexyl, heptyl, octyl, nonyl, decyl, undecyl and dodecyl, or an aryl group substituted with an alkyl group having 3 to 35 carbon atoms or an alkenyl group having 2 to 35 carbon atoms.

The group substituted on the aryl group may preferably include an alkyl group having 1 to 18 carbon atoms as exemplified by an unsubstituted alkyl group such as methyl, propyl, butyl, pentyl, hexyl, heptyl, octyl, nonyl, decyl, undecyl or dodecyl, a substituted alkyl group such as benzyl or phenethyl, or an alkenyl group having 2 to 20 carbon atoms as exemplified by an unsubstituted alkenyl group such as oleyl, cetyl or allyl or a substituted alkenyl group such as styryl. The aryl group may include groups such as phenyl, biphenyl and naphthyl, and preferably a phenyl group. The position of substitution on the aryl group may be any of the ortho, meta and para positions. A plurality of groups may be substituted thereon.

B and C each represent an ethyleneoxy group, a trimethyleneoxy group, a propyleneoxy group, or $$-(CH_2)_{n1}-(CH)_{m1}-(\underset{\underset{OH}{|}}{CH_2})_{l1}-O,$$

wherein n1, m1 and l1 each represent 0, 1, 2 or 3; m and n each represent an integer of 0 to 100. $X_1$ represents a hydrogen atom, or an alkyl group, an aralkyl group or an aryl group, which may include the groups exemplified for those represented by $A_2$.

Examples of the compound represented by Formula SI or SII are shown below.

Compound represented by Formula SI:

$$C_{12}H_{25}COO-(C_2H_4O)_{10}-H \quad \text{SI-1}$$

$$C_9H_{19}COO-(C_2H_4O)_4H \quad \text{SI-2}$$

$$C_{12}H_{25}NH-(C_2H_4O)_{10}-H \quad \text{SI-3}$$

$$C_{12}H_{25}NH-(C_2H_4O)_{15}-H \quad \text{SI-4}$$

$$HO-(C_2H_4O)_{20}-(\underset{\underset{CH_3}{|}}{CHCH_2O})_5-(C_2H_4O)_{20}-H \quad \text{SI-5}$$

$$C_{12}H_{25}-NHCH_2CH_2OH \quad \text{SI-6}$$

$$C_{12}H_{25}-N\begin{cases}(CH_2CH_2O)_{10}-H\\(CH_2CH_2O)_{10}-H\end{cases} \quad \text{SI-7}$$

$$C_{12}H_{25}-N\begin{cases}(CH_2CH_2O)_5H\\(CH_2CH_2O)_5H\end{cases} \quad \text{SI-8}$$

$$HO-(\underset{\underset{CH_3}{|}}{CHCH_2O})_{16.4}-(CH_2CH_2O)_{21.6}H \quad \text{SI-9}$$

$$HO-(\underset{\underset{CH_3}{|}}{CHCH_2O})_{16.4}-(CH_2CH_2O)_{14.4}H \quad \text{SI-10}$$

-continued $$HO-(\underset{\underset{CH_3}{|}}{CHCH_2O})_{20.7}-(CH_2CH_2O)_{18.2}H \quad \text{SI-11}$$

$$HO-(\underset{\underset{CH_3}{|}}{CHCH_2O})_{30.2}-(CH_2CH_2O)_{26.5}H \quad \text{SI-12}$$

$$HO-(\underset{\underset{CH_3}{|}}{CHCH_2O})_{30.2}-(CH_2CH_2O)_{39.8}H \quad \text{SI-13}$$

$$HO-(\underset{\underset{CH_3}{|}}{CHCH_2O})_{30.2}-(CH_2CH_2O)_{159.1}H \quad \text{SI-14}$$

$$HO-(\underset{\underset{CH_3}{|}}{CHCH_2O})_{35.3}-(CH_2CH_2O)_{48.6}H \quad \text{SI-15}$$

$$HO-(\underset{\underset{CH_3}{|}}{CHCH_2O})_{35.3}-(CH_2CH_2O)_{108.7}H \quad \text{SI-16}$$

$$HO-(\underset{\underset{CH_3}{|}}{CHCH_2O})_{38.8}-(CH_2CH_2O)_{34.1}H \quad \text{SI-17}$$

$$HO-(\underset{\underset{CH_3}{|}}{CHCH_2O})_{38.8}-(CH_2CH_2O)_{51.1}H \quad \text{SI-18}$$

$$HO-(\underset{\underset{CH_3}{|}}{CHCH_2O})_{38.8}-(CH_2CH_2O)_{119.3}H \quad \text{SI-19}$$

$$HO-(\underset{\underset{CH_3}{|}}{CHCH_2O})_{38.8}-(CH_2CH_2O)_{204.5}H \quad \text{SI-20}$$

$$HO-(\underset{\underset{CH_3}{|}}{CHCH_2O})_{47.4}-(CH_2CH_2O)_{41.7}H \quad \text{SI-21}$$

$$HO-(\underset{\underset{CH_3}{|}}{CHCH_2O})_{56.0}-(CH_2CH_2O)_{31.7}H \quad \text{SI-22}$$

$$HO-(\underset{\underset{CH_3}{|}}{CHCH_2O})_{56.0}-(CH_2CH_2O)_{49.2}H \quad \text{SI-23}$$

$$HO-(\underset{\underset{CH_3}{|}}{CHCH_2O})_{56.0}-(CH_2CH_2O)_{73.9}H \quad \text{SI-24}$$

$$HO-(\underset{\underset{CH_3}{|}}{CHCH_2O})_{56.0}-(CH_2CH_2O)_{295.5}H \quad \text{SI-25}$$

Compound represented by Formula SII:

$$C_{12}H_{25}-O-(C_2H_4O)_{10}-H \quad \text{SII-1}$$

$$C_8H_{17}-O-(C_3H_6O)_{15}-H \quad \text{SII-2}$$

$$C_9H_{19}-O-(C_2H_4O)_4H \quad \text{SII-3}$$

$$C_{10}H_{21}-O-(C_2H_4O)_{15}-H \quad \text{SII-4}$$

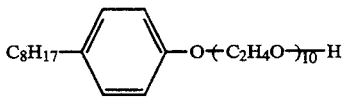

SII-5

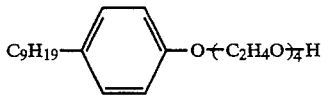

SII-6

-continued
SII-7
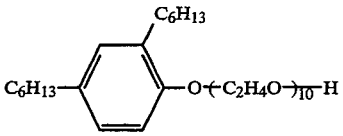
SII-8
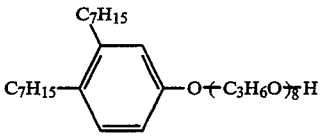
SII-9
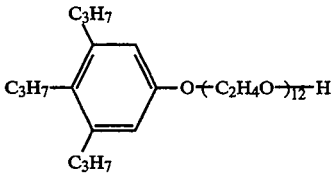
SII-10
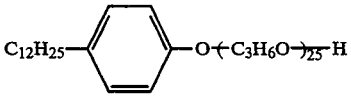
SII-11
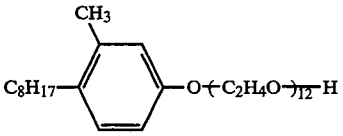
SII-12
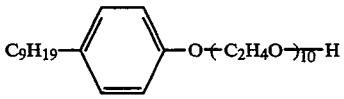
SII-13
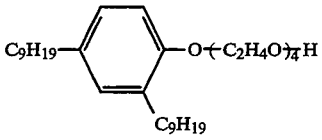
SII-14
$C_{12}H_{25}O(C_2H_4O)_4H$
SII-15
$C_6H_{13}O(C_2H_4O)_{10}H$
SII-16
$C_8H_{17}O(C_2H_4O)_{15}H$
SII-17
$C_{10}H_{21}O(C_2H_4O)_{10}H$
SII-18
$C_{12}H_{25}O(C_2H_4O)_{15}H$
SII-19
$C_{14}H_{29}O(C_2H_4O)_{15}H$
SII-20
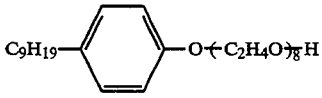
SII-21
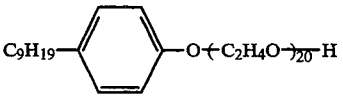
SII-22
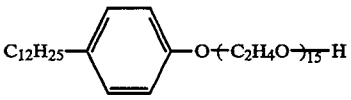
SII-23
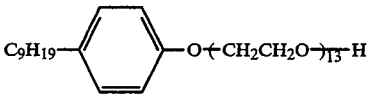
SII-24
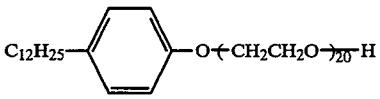
SII-25
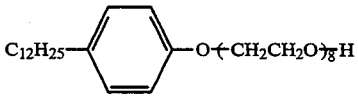
SII-26
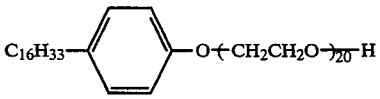
SII-27
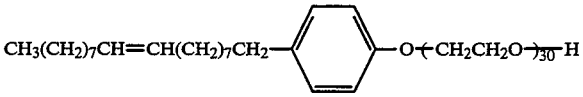
SII-28
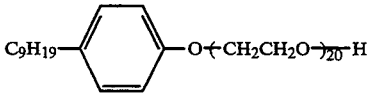
SII-29
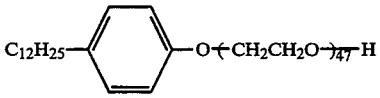
SII-30
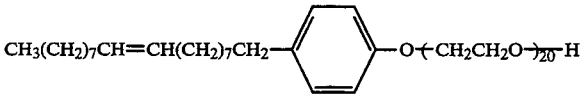

-continued
SII-31
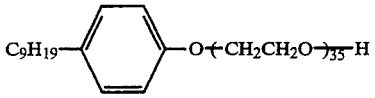
SII-32
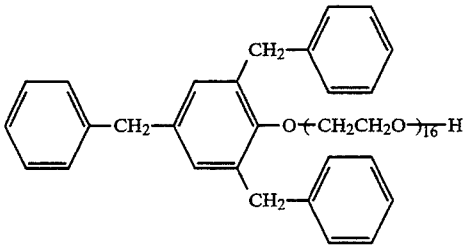
SII-33
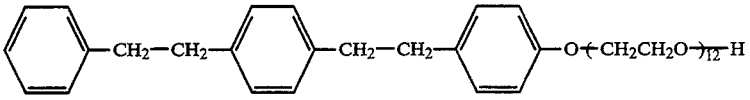
SII-34
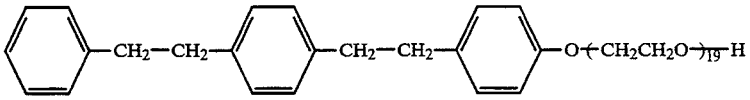
SII-35
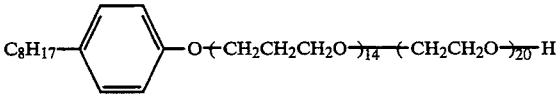
SII-36
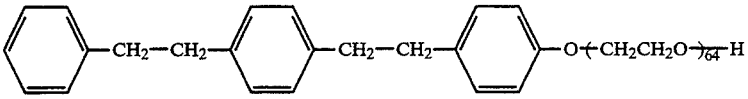
SII-37
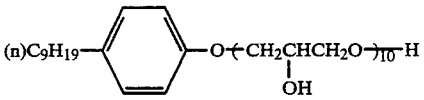
SII-38
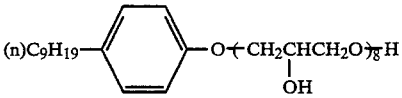
SII-39
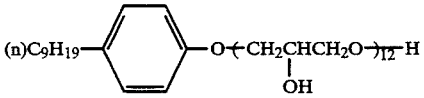
SII-40
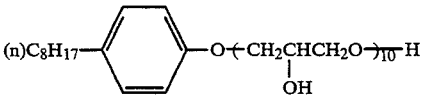
SII-41
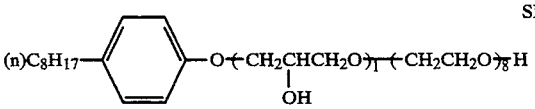
SII-42
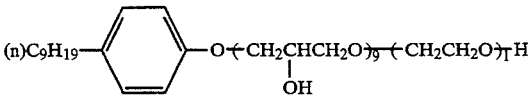
SII-43
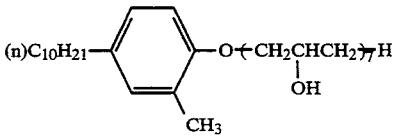
SII-44
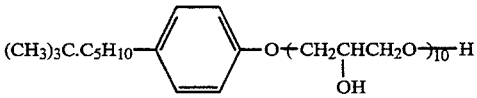
SII-45
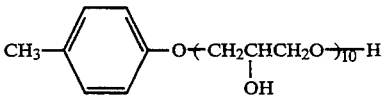
SII-46
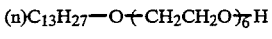
SII-47
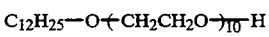
SII-48
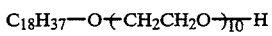
SII-49
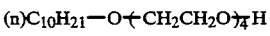
SII-50
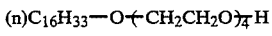
SII-51
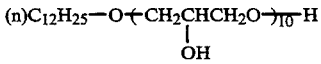
SII-52
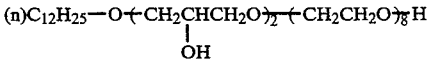
SII-53
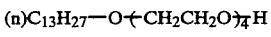
SII-54
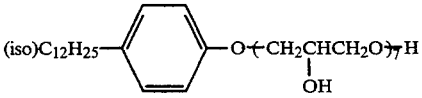

-continued
SII-55
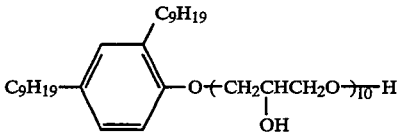
SII-56
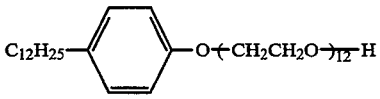
SII-57
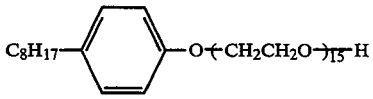
SII-58
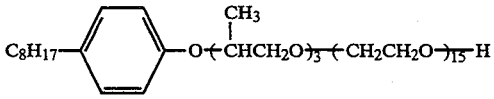
SII-59
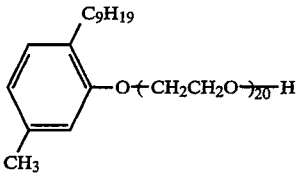
SII-60
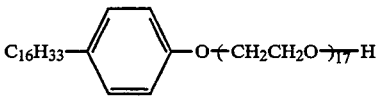
SII-61
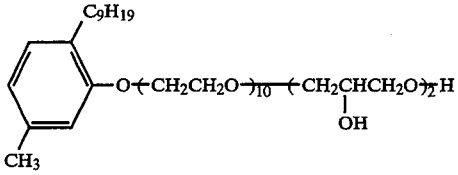
SII-62
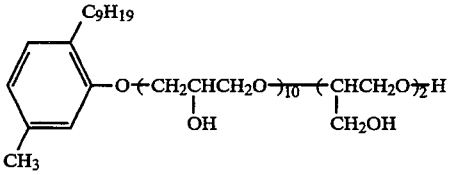
SII-63
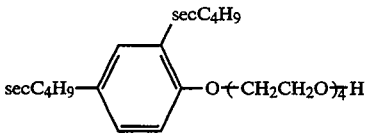
SII-64
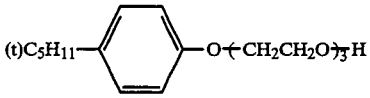
SII-65
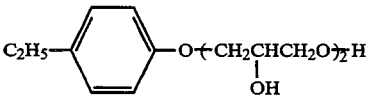
SII-66
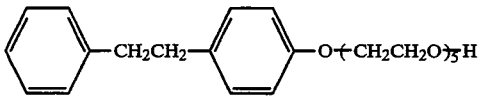
SII-67
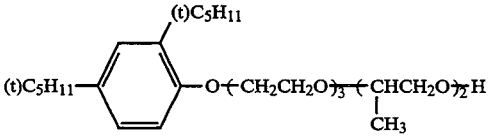
SII-68
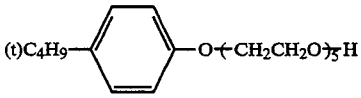
SII-69
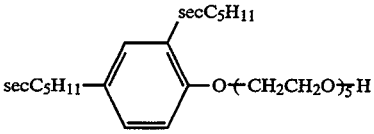
SII-70
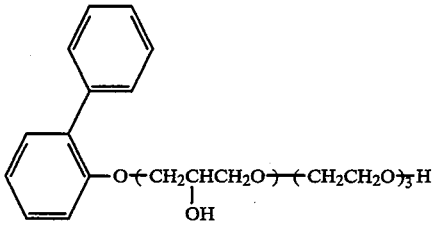
SII-71
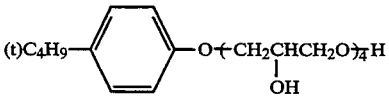
SII-72
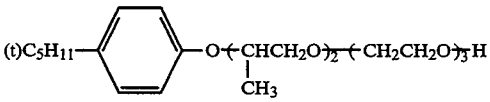
SII-73
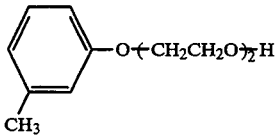
SII-74
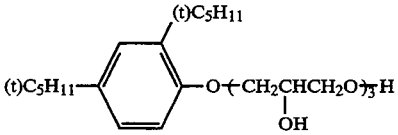

-continued

SII-75

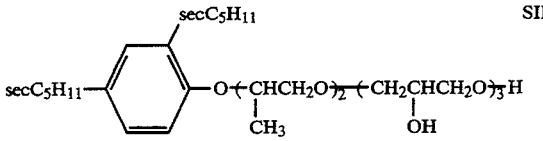

SII-76

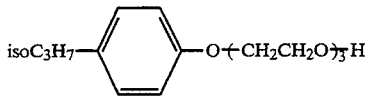

SII-77

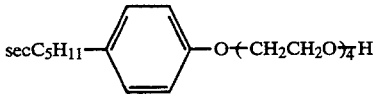

SII-78

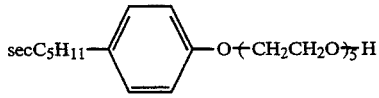

The water-soluble surface active agent may preferably be added in an amount of from 0.1 to 40 g, and more preferably from 0.3 to 20 g, per liter of the stabilizing solution.

The water-soluble organic siloxane compound may preferably be a compound represented by the following Formula SU-I.

Formula SU-I:

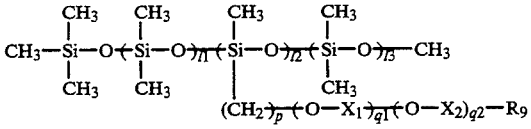

In Formula SU-I, $R_9$ represents a hydrogen atom, a hydroxyl group, a lower alkyl group, an alkoxyl group,

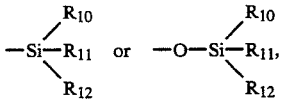

wherein $R_{10}$, $R_{11}$ and $R_{12}$ each represent a hydrogen atom or a lower alkyl group, and these $R_{10}$, $R_{11}$ and R12 may be the same or different from each other. l1 to l3 each represent an integer of 0 or 1 to 30, and p, q1and q2 each represent an integer of 0 or 1 to 30.

$X_1$ and $X_2$ each represent $—CH_2CH_2—$, $—CH_2CH_2CH_2—$,

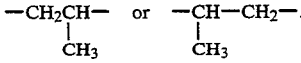

Examples of the compound represented by Formula SU-I are shown below.

Water-soluble organic siloxane compounds:

SU-I-1

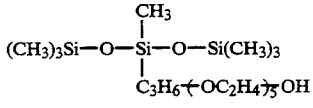

SU-I-2

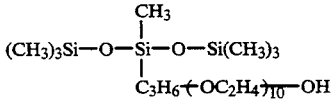

SU-I-3

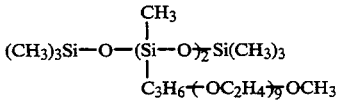

-continued

SU-I-4

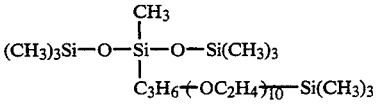

SU-I-5

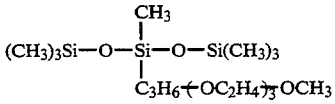

SU-I-6

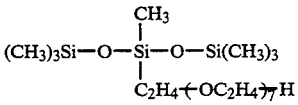

SU-I-7

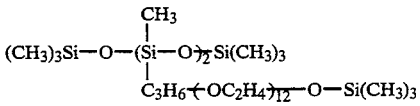

SU-I-8

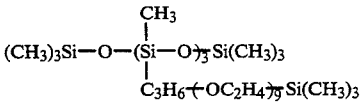

SU-I-9

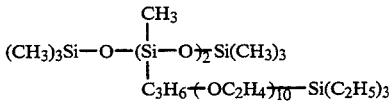

SU-I-10

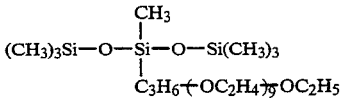

SU-I-11

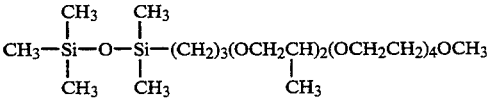

SU-I-12

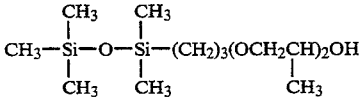

SU-I-13

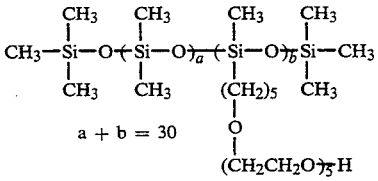

-continued

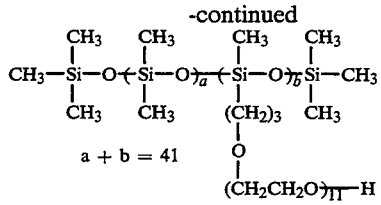

SU-I-14 a + b = 41

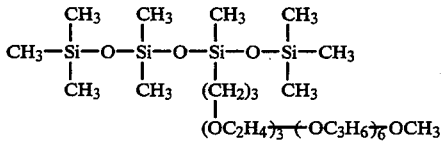

SU-I-15

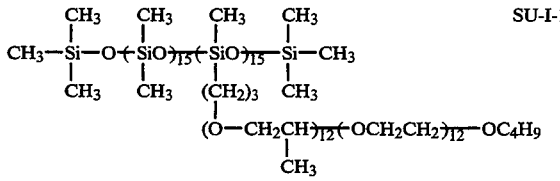

SU-I-16

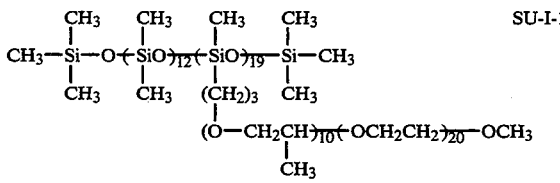

SU-I-17

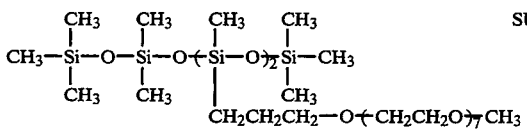

SU-I-18

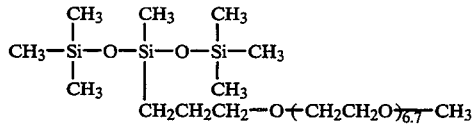

SU-I-19

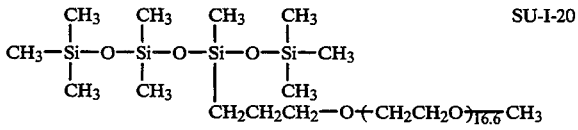

SU-I-20

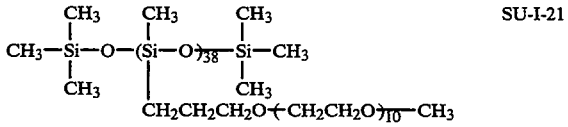

SU-I-21

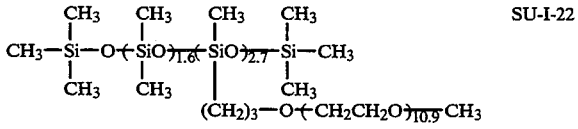

SU-I-22

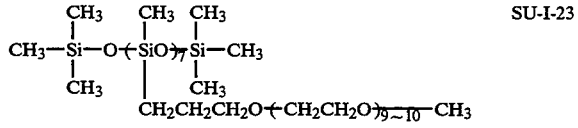

SU-I-23

Any of these water-soluble organic siloxane compounds having a polyoxyalkylene group may be added in an amount of from 0.01 to 20 g per liter of the stabilizing solution. Its addition within that range can be effective, in particular, effective for preventing precipitation from taking place and preventing yellow staining from occurring. Its addition in an amount less than 0.01 g/lit. may result in a conspicuous contamination of the surface of the light-sensitive material, and its addition in an amount more than 20 g/lit. may make the organic siloxane compound adhere to the surface of the light-sensitive material in a large quantity, resulting in an increase in the contamination.

The water-soluble organic siloxane compound means the commonly available water-soluble organic siloxane compounds as disclosed in, for example, Japanese Patent O.P.I. Publication No. 18333/1972, Japanese Patent Examined Publications No. 51172/1980 and No. 37538/1976, Japanese Patent O.P.I. Publication No. 62128/1974, and U.S. Pat. No. 3,545,970. These water-soluble organic siloxane compounds are readily available from UCC (Union Carbide Corp.) or Shin-Etsu Chemical Co., Ltd.

In the present invention, the stabilizing solution may preferably contain substantially no formaldehyde, and may preferably contain formaldehyde in an amount of not more than 0.2 g per liter of the stabilizing solution.

In the present invention, the stabilizing solution may preferably contain a chelating agent having a chelate stability constant with respect to iron ions, of not less than 8. Here, the chelate stability constant refers to the constant commonly known from L. G. Sillen and Martell, "Stability Constants of Metal-ion Complexes", The Chemical Society, London (1964), and S. Chaberek and A. E. Martell, "Organic Seqestering Agents", Wiley (1959).

The chelating agent having a chelate stability constant with respect to iron ions, of not less than 8 may include those disclosed in Japanese Patent Applications No. 234776/1990 and Japanese Patent O.P.I. Publication No. 182750/1991.

The above chelating agent may preferably be used in an amount of from 0.01 to 50 g, and more preferably from 0.05 to 20 g, per liter of the stabilizing solution, within the ranges of which good results can be obtained.

Preferred compounds that can be added to the stabilizing solution may include ammonium compounds. These are fed by ammonium salts of various inorganic compounds. The ammonium compound may be added in an amount preferably ranging from 0.001 mol to 1.0 mol, and more preferably ranging from 0.002 mol to 2.0 mols, per liter of the stabilizing solution.

The stabilizing solution may preferably also contain a metal salt used in combination with the above chelating agent. Such a metal salt may include salts of metals such as Ba, Ca, Ce, Co, In, La, Mn, Ni, Bi, Pb, Sn, Zn, Ti, Zr, Mg, Al and Sr. It can be fed in the form of an inorganic salt such as a halide, a hydroxide, a sulfate, a carbonate, a phosphate and an acetate, or in the form of water-soluble chelating agents. The metal salt may preferably be used in an amount ranging from $1\times10^{-4}$ to $1\times10^{-1}$ mol, and more preferably ranging from $4\times10^{-4}$ to $2\times10^{-2}$ mol, per liter of the stabilizing solution.

To the stabilizing solution, it is also possible to add a salt of an organic acid such as citric acid, acetic acid, succinic acid, oxalic acid or benzoic acid, a pH adjuster such as phosphate, borate, hydrochloric acid or sulfate, and so forth. These compounds may be used in any combination in any amount necessary for maintaining the pH of the stabilizing bath and in such an amount that its addition does not adversely affect the stability required when color photographic images are stored, and the prevention of occurrence of precipitates.

In the present invention, an antifungal agent may preferably be contained in the stabilizing solution. Such an antifungal agent may include compounds represented by the following Formulas B-1 to B-3. Use thereof in combination with the stabilizing solution can well bring about the intended effect of the present invention.

Formula B-1

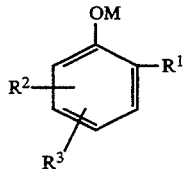

wherein $R^1$ represents an alkyl group, an cycloalkyl group, an aryl group, a hydroxyl group, an alkoxycarbonyl group, an amino group a carboxylic acid group (including a salt thereof) or a sulfonic acid group (including a salt thereof); $R^2$ and $R^3$ each represent a hydrogen atom, a halogen atom, an amino group, a nitro group, a hydroxyl group, an alkoxycarbonyl group, a carboxylic acid group (including a salt thereof) or a sulfonic acid group (including a salt thereof); and M represents a hydrogen atom, an alkali metal atom or an ammonium group.

Formula B-2

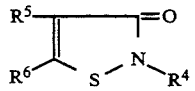

Formula B-3

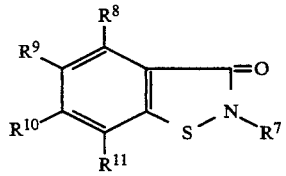

wherein $R^4$ represents a hydrogen atom, a halogen atom, an alkyl group, an aryl group, a halogenated alkyl group, $—R^{12}—OR^{13}$, $—CONHR^{14}$ (wherein $R^{12}$ represents an alkyl group and $R^{13}$ and $R^{14}$ each represent a hydrogen atom, an alkyl group or an arylalkyl group) or an arylalkyl group; $R^5$ and $R^6$ each represent a hydrogen atom, a halogen atom, a halogenated alkyl group or an alkyl group; $R^7$ represents a hydrogen atom, a halogen atom, an alkyl group, an aryl group, a halogenated alkyl group, an arylalkyl group, $—R^{15}—OR^{16}$ or $—CONHR^{17}$ (wherein $R^{15}$ represents an alkylene group, and $R^{16}$and $R^{17}$ each represent a hydrogen atom or an alkyl group); $R^8$, $R^9$, $R^{10}$ and $R^{11}$ each represent a hydrogen atom, a halogen atom, a hydroxyl group, an alkyl group, an amino group or a nitro group.

Examples of the compound represented by Formula B-1 are shown below.

(B-1-1)

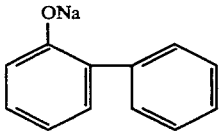

-continued (B-1-2)

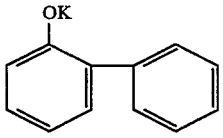

(B-1-3)

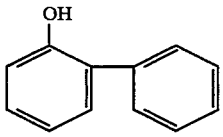

(B-1-4)

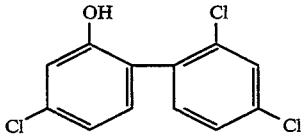

(B-1-5)

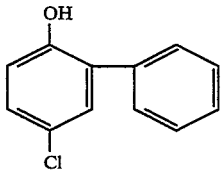

(B-1-6)

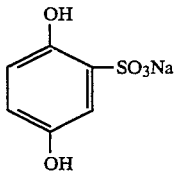

(B-1-7)

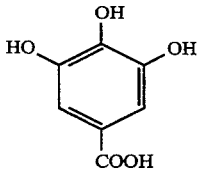

(B-1-8)

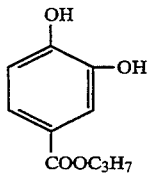

(B-1-9)

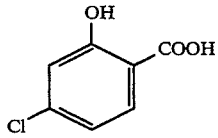

(B-1-10)

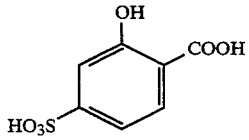

(B-1-11)

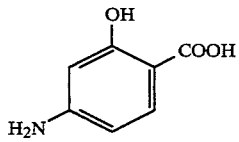

-continued (B-1-12)

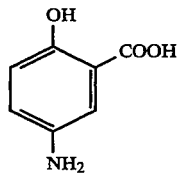

(B-1-13)

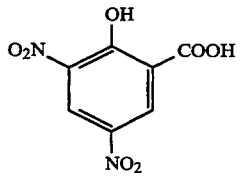

(B-1-14)

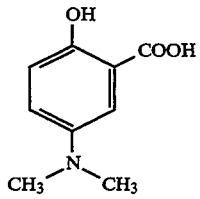

(B-1-15)

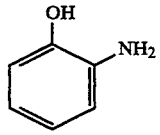

(B-1-16)

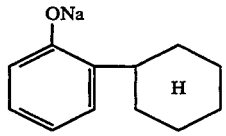

(B-1-17)

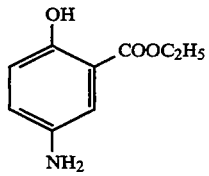

(B-1-18)

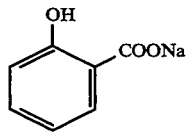

(B-1-19)

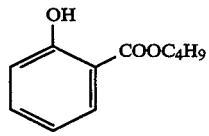

Some of compounds included in the above compound represented by Formula B-1, used in the present invention are known as antifungal agents for oranges or the like and commercially available. They are thus readily available to those skilled in the art. Of the above exemplary compounds, preferred compounds are B-1-1, B-1-2, B-1-3, B1-4 and B-1-5.

The above compound represented by Formula B-1, used in the present invention may preferably be used in an amount of from 0.03 to 50 g, more preferably from 0.12 to 10 g, and particularly preferably from 0.15 to 5 g, per liter of the stabilizing solution of the present invention.

Specific examples of the compounds represented by Formulas B-2 and B-3 are shown below.

[B-2-1] 2-Methyl-4-isothiazolin-3-one
[B-2-2] 5-Chloro-2-methyl-4-isothiazolin-3-one
[B-2-3] 2-Methyl-5-phenyl-4-isothiazolin-3-one
[B-2-4] 4-Bromo-5-chloro-2-methyl-4-isothiazolin-3-one
[B-2-5] 2-Hydroxymethyl-4-isothiazolin-3-one
[B-2-6] 2-(2-Ethoxyethyl)-4-isothiazolin-3-one
[B-2-7] 2-(N-methyl-carbamoyl)-4-isothiazolin-3-one
[B-2-8] 5-Bromoethyl-2-(N-dichlorophenyl-carbamoyl)-4-isothiazolin-3-one
[B-2-9] 5-Chloro-2-(2-phenylethyl)-4-isothiazolin-3-one
[B-2-10] 4-Methyl-2-(3,4-dichlorophenyl)-4-isothiazolin-3one
[B-3-1] 1,2-Benzisothiazolin-3-one
[B-3-2] 2-(2-Bromoethyl)-1,2-benzisothiazolin-3-one
[B-3-3] 2-Methyl-1,2-benzisothiazolin-3-one
[B-3-4] 2-Ethyl-5-nitro-1,2-benzisothiazolin-3-one
[B-3-5] 2-Benzyl-1,2-benzisothiazolin-3-one
[B-3-6] 5-Chloro-1,2-benzisothiazolin-3-one Synthesis methods of these exemplary compounds and examples of their application to other industrial fields are disclosed in U.S. Pat. Nos. 2,767,172, 2,767,173, 2,767,174 and 2,870,015, British Patent No. 848,130, French Patent No. 1,555,416, etc. Some compounds are on the market and available under trade names of TOPCIDE 300 (Permachem Asia Ltd.), TOPCIDE 600 (Permachem Asia Ltd.), FINECIDE J-700 (Tokyo Fine Chemical Co., Ltd.), or PROXEL GXL (I.C.I. Organics, Inc.).

Any of these compounds B-2 and B-3 may preferably be used in an amount ranging from 0.001 to 20 g, and more preferably ranging from 0.005 to 5 g, per liter of the stabilizing solution.

In the present invention, the stabilizing solution may preferably be replenished in an amount of not more than 800 ml per 1 $m^2$ of the light-sensitive material. Since, however, replenishment in an excessively reduced quantity may cause discoloration of dyes or deposition of salts on the surface of the light-sensitive material, it may more preferably be replenished in an amount of not less than 100 ml and not more than 620 ml. Specific amount of replenishment may vary depending on how stabilizing bath tanks are constituted. The more the number of the tanks are, the lower its value can be made.

The stabilizing solution may preferably have a temperature in the range of from 15° C. to 70° C., and more preferably in the range of from 20° C. to 55° C. The processing with the stabilizing solution may preferably be carried out for 120 seconds or less, more preferably from 3 seconds to 90 seconds, and most preferably from 6 seconds to 60 seconds.

In the present invention, the stabilizing bath, when two or more tanks are used, may be of the counter-current system (a system in which the solution is fed to a postbath and overflowed therefrom into a forebath), which is particularly preferable in view of the effect of the present invention, in particular, the low environmental pollution and the improvement in image storage stability.

In the processing according to the present invention, silver may be recovered from the stabilizing solution. For example, the electrolytic process as disclosed in French Patent No. 2,299,667, the precipitation process as disclosed in Japanese Patent O.P.I. Publication No.

73037/1977 and German Patent No. 23 31 220, the ion-exchange process as disclosed in Japanese Patent O.P.I. Publication No. 17114/1976 and German Patent No. 25 48 237, and the metal displacement process as disclosed in British Patent No. 1,353,805 can be effectively used. Such silver recovery is particularly preferable when silver is recovered from a tank solution by in-line treatment using the electrolytic process or an anion-exchange resin, since the rapid processing adaptability can be thereby more improved. Alternatively, silver may also be recovered from overflow waste liquor and regenerated for its use.

The stabilizing solution may also be subjected to a treatment such as ion exchange, electrodialysis (see Japanese Patent O.P.I. Publication No. 28949/1986), reverse osmosis (see Japanese Patent O.P.I. Publications No. 240153/1985 and No. 254151/1987) or the like. As the water used in the stabilizing solution, it is also preferred to use water having been dionized. This is because its use can achieve improvements in the antifungal properties of the stabilizing solution, the stability of the stabilizing solution and the storage stability of images. The water may be deionized by any methods so long as the washing water can be made to contain Ca and Mg ions in a concentration of 5 ppm or less after processing. For example, it is preferred to use, alone or in combination, treatments using an ion-exchange resin and a reverse osmosis membrane. The ion-exchange resin and the reverse osmosis membrane are disclosed in detail in KOKAI GIHO (Voluntary Technical Publication) 87-1984 or 89-20511.

After stabilizing, it is not necessary at all to carry out washing. It, however, is possible to optionally carry out rinsing, surface cleaning, etc. in a very short time using water in a very small quantity.

A color developing agent used in the step of color developing may include aminophenol compounds and p-phenylenediamine compounds. In the present invention, it is preferred to use a p-phenylenediamine compound having a water-soluble group. As to such a water-soluble group, at least one group may be present on the amino group or benzene nucleus of the p-phenylenediamine compound processing solution.

As specific water-soluble groups, the group may preferably include the following:

$-(CH_2)_n-CH_2OH$, $-(CH_2)_m-NHSO_2-(CH_2)_n-CH_3$, $-(CH_2)_m-O-(CH_2)_n-CH_3$, $-(CH_2CH_20)_nC_mH_{2m+1}$ wherein m and n each represent an integer of 0 or more), a —COOH group and an $-SO_3H$ group.

Examples of the color developing agent, preferably used in the present invention, include those disclosed in Japanese Patent O.P.I. Publication No. 182750/1991 and Japanese Patent Application No. 234776/1990, etc.

The color developing agent may preferably be added in an amount of not less than $0.5\times10^{-2}$ mol, more preferably in the range of from $1.0\times10^{-2}$ to $1.0\times10^{-1}$ mol, and most preferably in the range of from $1.5\times10^{-2}$ to $7.0\times10^{-2}$ mol, per liter of a color developing solution.

The color developing agent used in the color developing step may contain compounds usually used in developing solutions.

The color developing solution may usually have a pH of 7 or more, and preferably from about 9 to about 13.

In continuous processing, the color developing solution may preferably be replenished in an amount of not more than 1.5 liter, more preferably from 250 ml to 900 ml, and still more preferably from 300 ml to 700 ml, per 1.0 $m^2$ of the light-sensitive material in the case of light-sensitive color photographic materials for photographing.

EXAMPLES

The present invention will be described below in greater detail by giving Examples.

Example 1

The following stabilizing solutions were prepared.

| | |
|---|---|
| 1,2-Benzisothiazolin-3-one | 0.05 g |
| Surface active agent (exemplary compound SII-5) | 0.5 g |
| Compound of Formula F or comparative compound | as shown in Table 1 |
| Fixing solution*1) | 90 ml |

*1) The fixing solution was composed of the following

| | |
|---|---|
| Ammonium thiosulfate | 180 g |
| Ammonium sulfite | 18 g |
| Silver bromide | 0.5 g |

Made up to 1 liter by adding water, and the pH was adjusted to a given value (as shown in Table 1).

After the solutions were prepared, they were each stored at 30° C. in a beaker with an open-top area of 10 $cm^2$/lit., and evaluation was made on how many days lapsed before precipitates were produced because of sulfiding. Results obtained are shown in Table 1.

Made up to 1 liter by adding water, and adjusted to pH 7.0 using ammonium hydroxide or glacial acetic acid.

TABLE 1

| Compound of Formula F or comparative compound | | Stabilizing solution | Storage stability (Days before occurrence of |
|---|---|---|---|
| Compound | Amount | pH | sulfiding) |
| Aqueous 35% formaldehyde solution | 4 ml/l | 6.5 | 1 day |
| Aqueous 35% formaldehyde solution | " | 7.0 | 1 day |
| Aqueous 35% formaldehyde solution | " | 7.5 | 1 day |
| Aqueous 35% formaldehyde solution | " | 8.0 | 1 day |
| Aqueous 35% formaldehyde solution | " | 8.5 | 1 day |
| Aqueous 35% formaldehyde solution | " | 9.5 | 1 day |
| Aqueous 35% formaldehyde solution | " | 10.0 | 2 days |
| Exemplary Compound F-3 | 2.5 g/l | 6.5 | 5 days |
| Exemplary Compound F-3 | " | 7.0 | 6 days |
| Exemplary Compound F-3 | " | 7.5 | 9 days |
| Exemplary Compound F-3 | " | 8.0 | 10 days |
| Exemplary Compound F-3 | " | 8.5 | 11 days |
| Exemplary Compound F-3 | " | 9.5 | 10 days |
| Exemplary Compound F-3 | " | 10.0 | 9 days |
| Exemplary Compound F-2 | 2.5 g/l | 8.5 | 9 days |
| Exemplary Compound F-6 | " | " | 9 days |
| Exemplary Compound F-7 | " | " | 8 days |
| Exemplary Compound F-13 | " | " | 7 days |
| Exemplary Compound F-15 | " | " | 7 days |
| Exemplary Compound F-22 | " | " | 8 days |
| Exemplary Compound F-23 | " | " | 8 days |
| Exemplary Compound F-31 | " | " | 7 days |
| Exemplary Compound F-46 | " | " | 8 days |
| Exemplary Compound F-48 | " | " | 7 days |
| Exemplary Compound F-49 | " | " | 7 days |
| Exemplary Compound F-50 | " | " | 7 days |
| Exemplary Compound F-51 | " | " | 6 days |

TABLE 1-continued

| Compound of Formula F or comparative compound | | Stabilizing solution | Storage stability (Days before occurrence of sulfiding) |
|---|---|---|---|
| Compound | Amount | pH | |
| Exemplary Compound F-58 | " | " | 6 days |

As is clear from Table 1, stabilizing solutions to which formaldehyde is added show an extremely poor storage stability of the solution. On the other hand, stabilizing solutions making use of the compounds of Formula F all show a good solution storage stability.

Example 2

In this Example, the amounts of the components added in the light-sensitive silver halide photographic material are indicated as gram number per 1 $m^2$ unless particularly noted. Those of silver halides and colloidal silver are indicated in terms of silver.

On a triacetyl cellulose film support, the following layers were formed successively from the support side to produce a multi-layer light-sensitive color photographic material sample.

| | |
|---|---|
| **First layer: Anti-halation layer** | |
| Black colloidal silver | 0.18 |
| Ultraviolet absorbent UV-1 | 0.20 |
| Colored coupler CC-1 | 0.05 |
| Colored coupler CM-2 | 0.06 |
| High-boiling solvent Oil-1 | 0.20 |
| Gelatin | 1.5 |
| **Second layer: Intermediate layer** | |
| Ultraviolet absorbent UV-1 | 0.01 |
| High-boiling solvent Oil-1 | 0.01 |
| Gelatin | 1.2 |
| **Third layer: Low-speed red-sensitive emulsion layer** | |
| Silver iodobromide emulsion Em-1 | 1.0 |
| Silver iodobromide emulsion Em-2 | 0.6 |
| Spectral sensitizer S-1 | $2.2 \times 10^{-4}$ mol/mol · Ag |
| Spectral sensitizer S-2 | $2.5 \times 10^{-4}$ mol/mol · Ag |
| Spectral sensitizer S-3 | $0.5 \times 10^{-4}$ mol/mol · Ag |
| Cyan coupler C-4' | 1.2 |
| Cyan coupler C-2' | 0.6 |
| Colored cyan coupler CC-1 | 0.05 |
| DIR compound D-1 | 0.002 |
| High-boiling solvent Oil-1 | 0.5 |
| Gelatin | 1.2 |
| **Fourth layer: High-speed red-sensitive emulsion layer** | |
| Silver iodobromide emulsion Em-3 | 2.0 |
| Spectral sensitizer S-1 | $2.2 \times 10^{-4}$ mol/mol · Ag |
| Spectral sensitizer S-2 | $2.5 \times 10^{-4}$ mol/mol · Ag |
| Spectral sensitizer S-3 | $0.5 \times 10^{-4}$ mol/mol · Ag |
| Cyan coupler C-1' | 0.20 |
| Cyan coupler C-2' | 0.03 |
| Cyan coupler C-3' | 1.15 |
| Colored cyan coupler CC-1 | 0.015 |
| DIR compound D-2 | 0.05 |
| High-boiling solvent Oil-1 | 0.5 |
| Gelatin | 1.3 |
| **Fifth layer: Intermediate layer** | |
| Gelatin | 0.5 |
| **Sixth layer: Low-speed green-sensitive emulsion layer** | |
| Silver iodobromide emulsion Em-1 | 1.1 |
| Spectral sensitizer S-4 | $5 \times 10^{-4}$ mol/mol · Ag |
| Spectral sensitizer S-5 | $2 \times 10^{-4}$ mol/mol · Ag |
| Magenta coupler M-1 | 0.50 |
| Colored magenta coupler CM-1 | 0.05 |
| DIR compound D-3 | 0.015 |
| DIR compound D-4 | 0.020 |
| High-boilingsolvent Oil-2 | 0.5 |
| Gelatin | 1.0 |
| **Seventh layer: Intermediate layer** | |
| Gelatin | 0.9 |
| High-boiling solvent Oil-3 | 0.2 |

-continued

| | |
|---|---|
| **Eighth layer: High-speed green-sensitive emulsion layer** | |
| Silver iodobromide emulsion Em-3 | 1.4 |
| Spectral sensitizer S-6 | $1.5 \times 10^{-4}$ mol/mol · Ag |
| Spectral sensitizer S-7 | $2.3 \times 10^{-4}$ mol/mol · Ag |
| Spectral sensitizer S-8 | $0.9 \times 10^{-4}$ mol/mol · Ag |
| Magenta coupler M-2 | 0.10 |
| Magenta coupler M-3 | 0.18 |
| Colored magenta coupler CM-2 | 0.05 |
| DIR compound D-3 | 0.01 |
| High-boiling solvent Oil-3 | 0.5 |
| Gelatin | 1.1 |
| **Ninth layer: Yellow filter layer** | |
| Yellow colloidal silver | 0.12 |
| Anti-color-stain agent SC-1 | 0.1 |
| High-hoiling solvent Oil-3 | 0.1 |
| Gelatin | 0.8 |
| **Tenth layer: Low-speed blue-sensitive emulsion layer** | |
| Silver iodobromide emulsion Em-1 | 0.30 |
| Silver iodobromide emulsion Em-2 | 0.25 |
| Spectral sensitizer S-10 | $7 \times 10^{-4}$ mol/mol · Ag |
| Yellow coupler Y-1 | 0.6 |
| Yellow coupler Y-2 | 0.2 |
| DIR compound D-2 | 0.01 |
| High-boiling solvent Oil-3 | 0.15 |
| Gelatin | 1.2 |
| **Eleventh layer: High-speed blue-sensitive emulsion layer** | |
| Silver iodobromide emulsion Em-4 | 0.50 |
| Silver iodobromide emulsion Em-1 | 0.22 |
| Spectral sensitizer S-9 | $1.3 \times 10^{-4}$ mol/mol · Ag |
| Spectral sensitizer S-10 | $3 \times 10^{-4}$ mol/mol · Ag |
| Yellow coupler Y-1 | 0.36 |
| Yellow coupler Y-2 | 0.12 |
| High-boiling solvent Oil-3 | 0.07 |
| Gelatin | 1.2 |
| **Twelvth layer: First protective layer** | |
| Fine-grain silver iodobromide emulsion (average grains size: 0.08 μm; AgI: 2.5 mol %) | 0.40 |
| Ultraviolet absorbent UV-1 | 0.10 |
| Ultraviolet absorbent UV-2 | 0.05 |
| Hih-boiling solvent Oil-1 | 0.1 |
| High-boiling solvent Oil-4 | 0.1 |
| Formalin scavenger HS-1 | 0.5 |
| Formalin scavenger HS-2 | 0.2 |
| Gelatin | 1.2 |
| **Thirteenth layer: Second protective layer** | |
| Surface active agent Su-1 | 0.005 |
| Alkali-soluble matting agent (average particle diameter: 2 μm) | 0.10 |
| Cyan dye AIC-1 | 0.01 |
| Magenta dye AIM-1 | 0.01 |
| Lubricant WAX-1 | 0.04 |
| Gelatin | 0.7 |

In addition to the above composition, coating aid Su-2, dispersing agent Su-3, anticeptic agent DI-1, stabilizer Stab-1 and antifoggants AF-1 and AF-2 were added to each layer.

Em-1

A monodisperse emulsion with a surface low silver iodide content, having an average grains size of 0.46 μm and an average silver iodide content of 7.0 mol %.

Em-2

A monodisperse emulsion with a uniform composition, having an average grains size of 0.32 μm and an average silver iodide content of 2.5 mol %.

Em-3

A monodisperse emulsion with a surface low silver iodide content, having an average grains size of 0.78 μm and an average silver iodide content of 6.0 mol %.

Em-4

A monodisperse emulsion with a surface low silver iodide content, having an average grains rains size of 0.95 μm and an average silver iodide content of7.5 mol %.

The emulsions Em-1, Em-3 and Em-4 are silver iodobromide emulsions prepared by making reference to Japanese Patent O.P.I. Publications No. 138538/1985 and No. 245151/1986, having a multi-layer structure and mainly comprised of octahedral grains. Em-1 to Em-4 each have an average grain size/grain thickness value of 1.0, and a coefficient of variation in grain size distribution, of 14%, 10%, 12% and 12%, respectively.

S-1

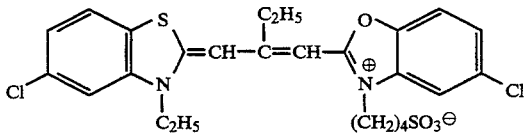

S-2

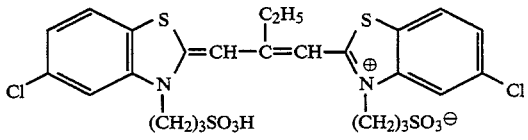

S-3

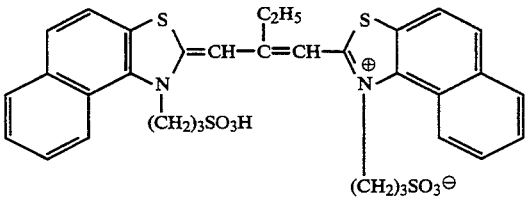

S-4

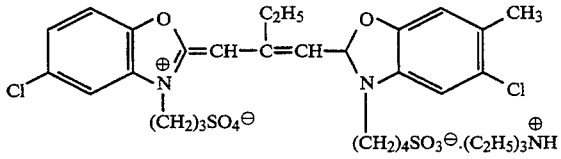

S-5

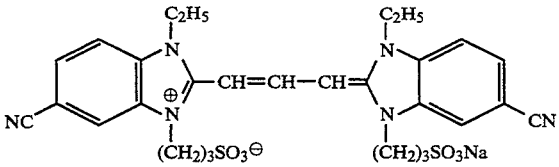

S-6

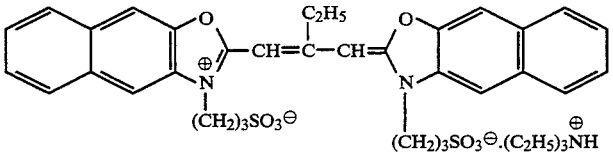

S-7

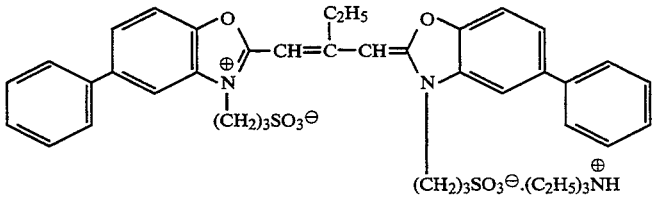

S-8

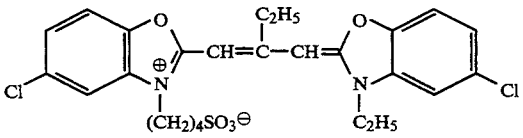

S-9

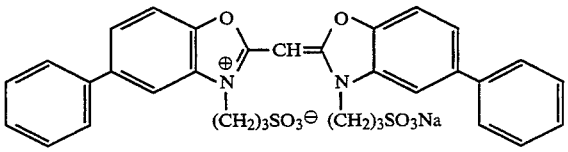

S-10

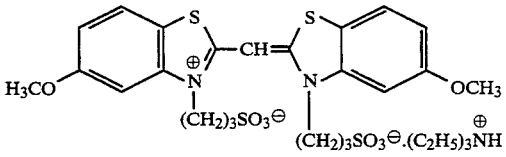

-continued
C-1′
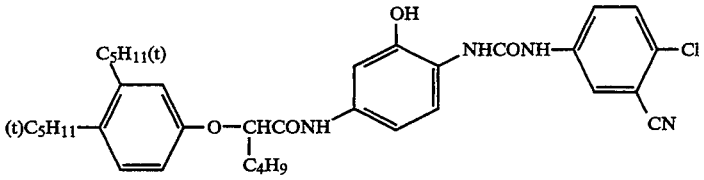
C-2′
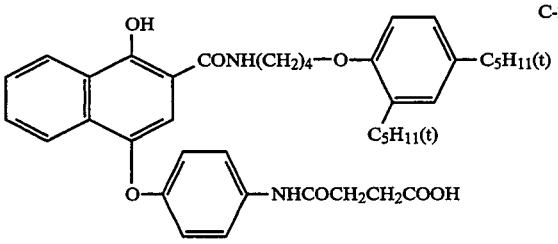
C-3′
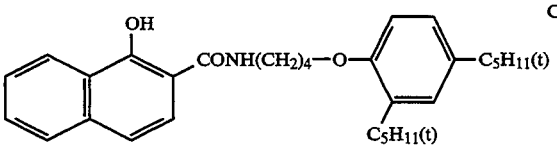
C-4′
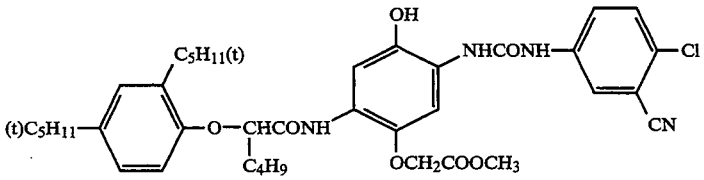
M-1
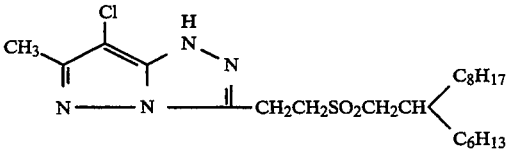
M-2
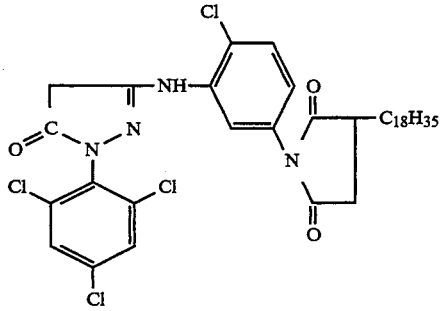
M-3
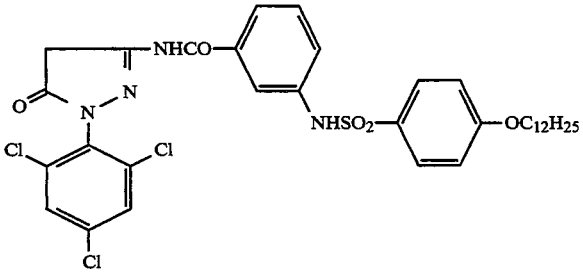
Y-1
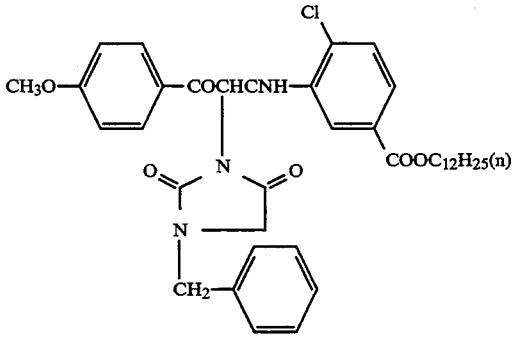
Y-2
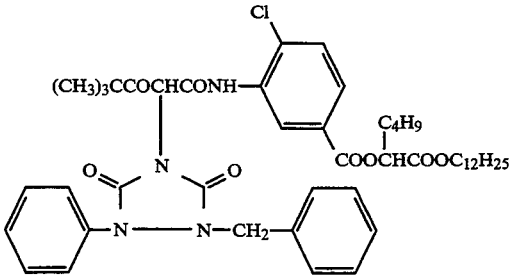

-continued
CC-1
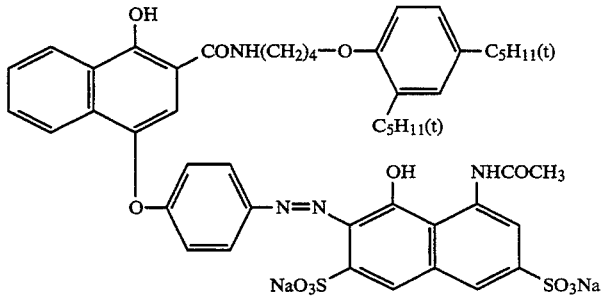
CM-1
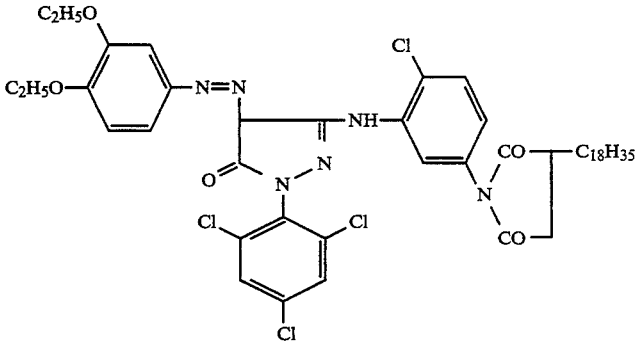
CM-2
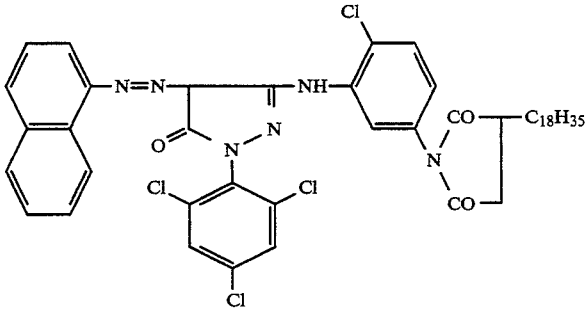
D-1
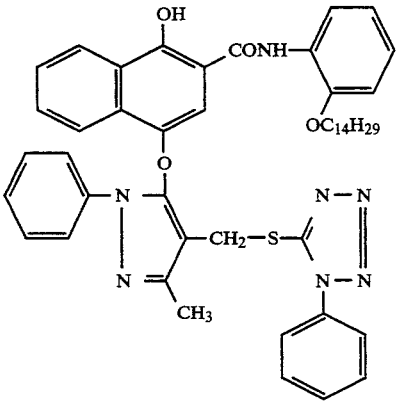
D-2
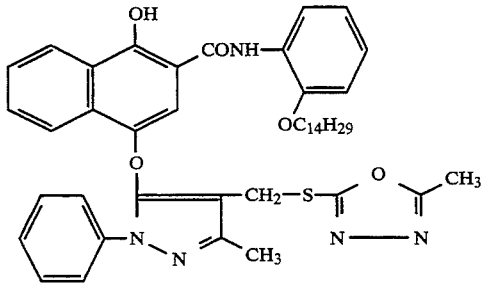

-continued
D-3
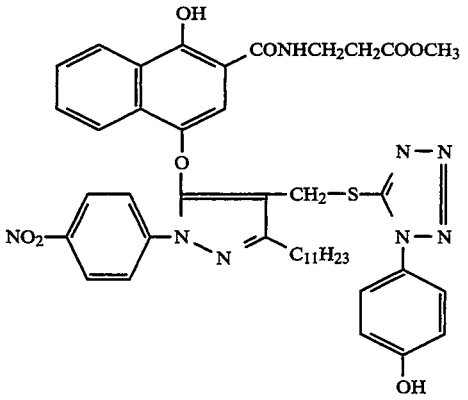
D-4
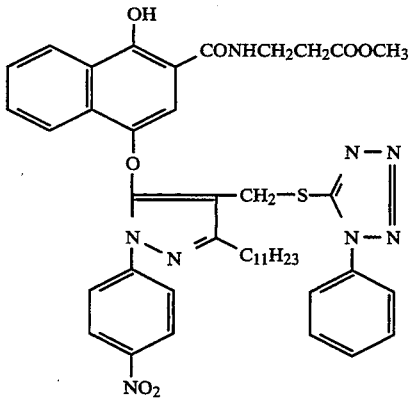
UV-1
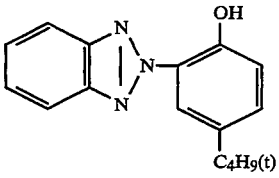
UV-2
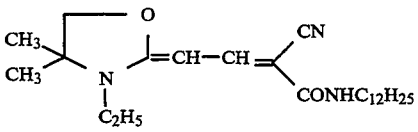
HS-1
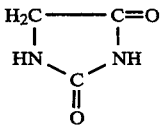
HS-2
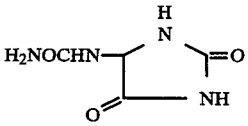
H-1
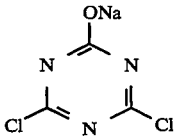
H-2
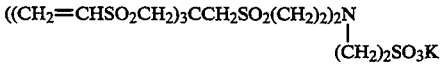
Su-1
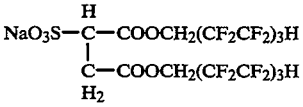
Su-2
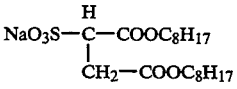
Su-3
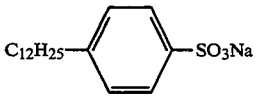
WAX-1
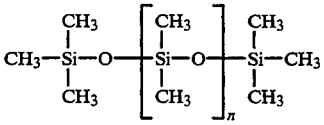
Sc-1
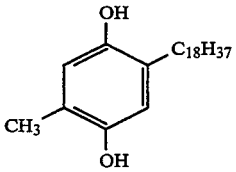
AIC-1
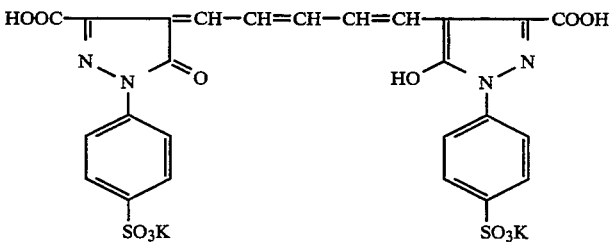

-continued

AIM-1

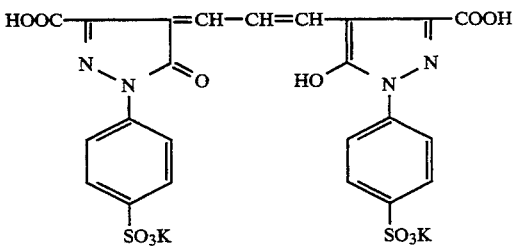

Stab-1

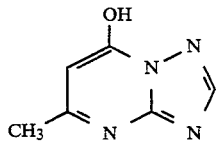

AF-1

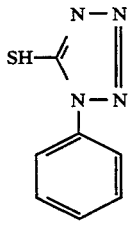

AF-2

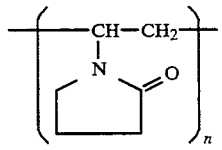

DI-1

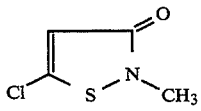

and

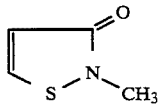

Oil-1

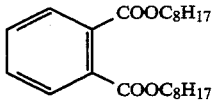

Oil-2

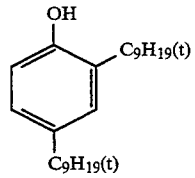

Oil-3

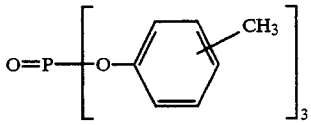

Oil-4

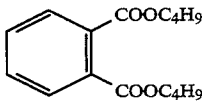

Film samples prepared in this way were subjected to practical exposure using a camera, and running tests were carried out under the following conditions.

| Processing Step | Processing Time | Processing temperature | Amount of replenishing |
|---|---|---|---|
| Color developing | 3 min 15 sec | 38° C. | 720 ml |
| Bleaching | 45 sec | 38° C. | 155 ml |
| Fixing | 1 min 30 sec | 38° C. | 500 ml |
| Stabilizing | 50 sec | 38° C. | 775 ml |
| Drying | 1 min | 40–70° C. | — |

The stabilizing was carried out in a three-bath countercurrent system and by a system in which the stabilizing solution is replenished to the final bath and its overflow is flowed into the forebath.

| Color developing solution | |
|---|---|
| Potassium carbonate | 30 g |
| Sodium hydrogencarbonate | 2.5 g |
| Potassium sulfite | 3.0 g |
| Sodium bromide | 1.2 g |
| Potassium iodide | 0.6 mg |
| Hydroxylamine sulfate | 2.5 g |
| Sodium chloride | 0.6 g |
| 4-Amino-3-methyl-N-ethyl-N-(β-hydroxyethyl)aniline sulfate | 4.5 g |
| Diethylenetriaminepentaacetic acid | 3.0 g |

-continued

| Color developing solution | |
|---|---|
| Potassium hydroxide | 1.2 g |

Made up to 1 liter by adding water, and adjusted to pH 10.01 using potassium hydroxide or 20% sulfuric acid.

| Color developing replenishing solution | |
|---|---|
| Potassium carbonate | 38 g |
| Sodium hydrogencarbonate | 3 g |
| Potassium sulfite | 7 g |
| Sodium bromide | 0.6 g |
| Hydroxylamine sulfate | 3.1 g |
| 4-Amino-3-methyl-N-ethyl-N-(β-hydroxyethyl)aniline sulfate | 5.9 g |
| Diethylenetriaminepentaacetic acid | 3.0 g |
| Potassium hydroxide | 2 g |

Made up to 1 liter by adding water, and adjusted to pH 10.20 using potassium hydroxide or 207% sulfuric acid.

| Bleaching solution | |
|---|---|
| Ferric ammonium 1,3-propylenediaminetetraacetate | 0.32 mol |
| Disodium ethylenediaminetetraacetate | 10 g |
| Ammonium bromide | 100 g |
| Glacial acetic acid | 10 g |

-continued

| Bleaching solution | |
|---|---|
| Succinic acid | 40 g |
| Ammonium nitrate | 40 g |

Made up to 1 liter by adding water, and adjusted to pH 4.0 using ammonia water or glacial acetic acid.

| Bleaching replenishing solution | |
|---|---|
| Ferric ammonium 1,3-propylenediaminetetraacetate | 0.35 mol |
| Disodium ethylenediaminetetraacetate | 2 g |
| Ammonium bromide | 120 g |
| Ammonium nitrate | 50 g |
| Glacial acetic acid | 10 g |
| Succinic acid | 40 g |

Made up to 1 liter by adding water, and adjusted to pH 3.4 using ammonia water or glacial acetic acid.

| Fixing solution and fixing replenishing solution | |
|---|---|
| Ammonium thiosulfate | 210 g |
| Anhydrous sodium bisulfite | 30 g |
| Sodium metabisulfite | 4.0 g |
| Disodium ethylenediaminetetraacetate | 2.0 g |
| Urea | 1.0 g |

Made up to 1 liter by adding water, and adjusted to pH 6.5 using glacial acetic acid and ammonia water.

| Stabilizing solution and stabilizing replenishing solution | |
|---|---|
| Benzoisothiazolin-3-one | 0.05 g |
| Surface active agent (Exemplary Compound SII-5) | 0.3 g |
| Compound of Formula F or comparative compound (as shown in Table 2) | in amount as shown in Table 2 |

Made up to 1 liter by adding water, and adjusted to the pH as shown in Table 2, by adding sulfuric acid or potassium hydroxide.

Running processing was carried out using an automatic processor, until the replenishing solution was supplied in a threefold quantity of the capacity of the stabilizing tank.

Magenta densities at minimum density portions were measured on processed film samples on which the running processing was completed. Then the samples were stored for two weeks in an environment of 75° C. and 20% RH, and the magenta maximum densities after storage were measured to determine the rate of discoloration (or fading) of dyes. The samples were also stored for one week in an environment of 75° C. and 60% RH, and their yellow densities at non-image portions were measured to determine yellow stain. Then 1 liter of second-tank solution in the stabilizing tanks was stored at 35° C. in a beaker with an open-top area of 10 $cm^2$/lit., and evaluation was made on the solution storage stability (days before occurrence of sulfiding).

Results obtained are shown together in Table 2.

TABLE 2

| Compound of Formula F or comparative compound | | Stabilizing solution | * Storage stability | Fading rate | Yellow stain |
|---|---|---|---|---|---|
| Compound | Amount | pH | | (%) | |
| Aqueous 35% formaldehyde solution | 4 ml | 6.5 | 1 day | 3.0 | 0.00 |
| Aqueous 35% formaldehyde solution | " | 7.0 | 1 day | 3.0 | 0.00 |
| Aqueous 35% formaldehyde solution | " | 7.5 | 1 day | 3.0 | 0.00 |
| Aqueous 35% formaldehyde solution | " | 8.0 | 1 day | 3.1 | 0.00 |
| Aqueous 35% formaldehyde solution | " | 8.5 | 1 day | 310 | 0 00 |
| Aqueous 35% formaldehyde solution | " | 9.5 | 1 day | 3.1 | 0.00 |
| Aqueous 35% formaldehyde solution | " | 10.0 | 2 days | 3.0 | 0.00 |
| Aqueous 35% formaldehyde solution | " | 10.5 | 2 days | 3.0 | 0.00 |
| Aqueous 35% formaldehyde solution | " | 11.0 | 2 days | 3.1 | 0.00 |
| Exemplary Compound F-3 | 2.5 g | 6.5 | 4 days | 5.8 | 0 00 |
| Exemplary Compound F-3 | " | 7.0 | 6 days | 5.5 | 0.00 |
| Exemplary Compound F-3 | " | 7.5 | 7 days | 4.1 | 0.00 |
| Exemplary Compound F-3 | " | 8.0 | 9 days | 3.2 | 0.00 |
| Exemplary Compound F-3 | " | 8.5 | 10 days | 2.9 | 0.00 |
| Exemplary Compound F-3 | " | 9.5 | 9 days | 3.3 | 0.02 |
| Exemplary Compound F-3 | " | 10.0 | 8 days | 4.0 | 0.04 |
| Exemplary Compound F-3 | " | 10.5 | 8 days | 5.4 | 0.19 |
| Exemplary Compound F-3 | " | 11.0 | 8 days | 5.6 | 0.23 |
| Exemplary Compound F-2 | 2.5 g | 8.5 | 8 days | 3.3 | 0.02 |
| Exemplary Compound F-6 | " | " | 8 days | 3.4 | 0.02 |
| Exemplary Compound F-7 | " | " | 7 days | 3.7 | 0.03 |
| Exemplary Compound F-8 | " | " | 7 days | 4.4 | 0.02 |
| Exemplary Compound F-10 | " | " | 6 days | 4.6 | 0.02 |
| Exemplary Compound F-13 | " | " | 7 days | 4.3 | 0.02 |
| Exemplary Compound F-21 | " | " | 7 days | 4.7 | 0.03 |
| Exemplary Compound F-22 | " | " | 6 days | 4.8 | 0.02 |
| Exemplary Compound F-23 | " | " | 7 days | 3.2 | 0.01 |
| Exemplary Compound F-24 | " | " | 7 days | 3.6 | 0.02 |
| Exemplary Compound F-37 | " | " | 6 days | 4.9 | 0.03 |
| Exemplary Compound F-46 | " | " | 5 days | 4.0 | 0.02 |
| Exemplary Compound F-48 | " | " | 6 days | 6.0 | 0.03 |
| Exemplary Compound F-50 | " | " | 5 days | 5.8 | 0.02 |
| Exemplary Compound F-51 | " | " | 5 days | 5.6 | 0.03 |
| Exemplary Compound F-59 | " | " | 4 days | 6.0 | 0.03 |

TABLE 2-continued

| Compound of Formula F or comparative compound | | Stabilizing solution | * Storage stability | Fading rate | Yellow stain |
|---|---|---|---|---|---|
| Compound | Amount | pH | | (%) | |
| None | | | 12 days | 30.0 | 0.18 |

*Stabilizing solution storage stability (days before occurrence of sulfiding)

As is clear from the results shown in Table 2, use of formaldehyde brings about very good results in regard to dye image stability and yellow stain, but causes a very poor storage stability of stabilizing solutions.

On the other hand, in the cases in which the compounds of the present invention are used, a good image stability is seen in both fresh solutions and stored solutions when the pH is in the range of from 7.5 to 10.0. However, an unsatisfactory image stability is seen in fresh solutions when the pH is outside the above range, i.e., on the lower side. Yellow stain is greater and storage stability of stored solutions is deteriorated when the pH is on the higher side.

Example 3

The film samples as used in Example 2 were subjected to practical exposure using a camera, and running tests were carried out under the following conditions.

| Processing Step | Processing Time | Processing temp. | Amount of replenishing | Processing tank capacity |
|---|---|---|---|---|
| Color developing | 3 min 15 sec | 38° C. | 775 ml | 20 lit. |
| Bleaching | 45 sec | 38° C. | 155 ml | 5 lit. |
| Fixing | 1 min 30 sec | 38° C. | 900 ml | 10 lit. |
| Stabilizing 1 | 20 sec | 38° C. | — | 3 lit. |
| Stabilizing 2 | 20 sec | 38° C. | — | 3 3 lit. |
| Stabilizing 3 | 20 sec | 38° C. | 900 ml | 3.7 lit. |
| Drying | 1 min | 40–70° C. | — | — |

The amount of replenishing is indicated as a value per 1 $m^2$ of light-sensitive material.

The processing solutions and replenishing solutions were the same as those used in Example 2. The compounds of Formula F or comparative compounds used in the stabilizing solutions and stabilizing replenishing solutions and the amounts thereof were as shown in Table 3.

Stabilizing was carried out in a three-bath countercurrent system and by a system in which the stabilizing solution is replenished to the final bath and its overflow is flowed into the forebath. The running processing was carried out for 3 months according to the solution replacement rate as shown in Table 3, and samples obtained by subjecting the above samples to wedge exposure were processed to examine magenta fading rate and yellow stain in the same manner as in Example 2. The storage stability of the stabilizing solutions was evaluated on the basis of the days before occurrence of sulfiding in the course of running. Results obtained are shown in Table 3.

TABLE 3

| Compound of Formula F or comparative compound | | Stabilizing solution | | Fading rate | Yellow stain | * Storage stability |
|---|---|---|---|---|---|---|
| Compound | Amount | pH | (1) | (%) | | (days) |
| Formaldehyde 35% | 4 ml | 8.5 | 0.2 | 3.3 | 0.00 | >90 |
| Formaldehyde 35% | " | " | 0.05 | 4.1 | 0.03 | 74 |
| Formaldehyde 35% | " | " | 0.02 | 5.5 | 0.05 | 29 |
| Formaldehyde 35% | " | " | 0.01 | 10.1 | 0.11 | 5 |
| Formaldehyde 35% | 1 ml | " | 0.2 | 15.5 | 0.00 | >90 |
| Formaldehyde 35% | " | " | 0.05 | 17.8 | 0.06 | >90 |
| Formaldehyde 35% | " | " | 0.02 | 20.4 | 0.12 | >90 |
| Formaldehyde 35% | " | " | 0.01 | 25.3 | 0.18 | 35 |
| Exemplary Compound F-3 | 2.5 g | " | 0.2 | 2.9 | 0.01 | >90 |
| Exemplary Compound F-3 | " | " | 0.05 | 2.9 | 0.01 | >90 |
| Exemplary Compound F-3 | " | " | 0.02 | 2.9 | 0.01 | >90 |
| Exemplary Compound F-3 | " | " | 0.01 | 3.0 | 0.02 | >90 |

(1)Solution replacement rate (rotation/day)
*Stabilizing solution storage stability (days before occurrence of sulfiding)

The solution replacement rate indicates the amount in which the stabilizing replenishing solution has been supplied based on the total capacity of all stabilizing tanks. An indication "0.1 rotation per day" means that light-sensitive materials are processed in such a rate that the stabilizing replenishing solution is supplied in an amount of 1/10 of the total capacity of all stabilizing tanks per day.

As is seen from the results shown in Table 7, the stabilizing solutions containing 4 ml/lit. of formaldehyde give good results in respect of fading Fate and yellow stain, but tend to cause sulfiding when the processing is carried out in a small quantity, i.e., the solution replacement rate is low. When the quantity of formaldehyde is reduced to 1 ml/lit., the stabilizing solutions less tend to cause sulfiding, but give unsatisfactory results in respect of fading rate. The stabilizing solutions according to the present invention, however, show good performance even when the processing is carried out in a small quantity.

Example 4

Using the light-sensitive materials as used in Example 4, evaluation was made in the same manner as in Example 2, except that the light-sensitive materials were processed under the following conditions.

| Processing Step | Processing Time | Processing temperature | Amount of replenishing |
|---|---|---|---|
| Color developing | 3 min 15 sec | 38° C. | 775 ml |
| Bleaching | 4 min 20 sec | 38° C. | 155 ml |
| Washing | 2 min 10 sec | 38° C. | 15 lit. |
| Fixing | 4 min 20 sec | 38° C. | 500 ml |
| Washing | 3 min 15 sec | 18–42° C. | 75 lit. |
| Stabilizing | 2 min 10 sec | 38° C. | 775 ml |

-continued

| Processing Step | Processing Time | Processing temperature | Amount of replenishing |
|---|---|---|---|
| Drying | 3 min | 40–70° C. | — |

The amount of replenishing is indicated as a value per 1 $m^2$ of light-sensitive material.

Color Developing Solution and Color Developing Replenishing Solution

The same as those in Example 2.

| Bleaching solution | |
|---|---|
| Ferric ammonium 1,3-propylenediaminetetraacetate | 0.12 mol |
| 3-Propylenediaminetetraacetate | 5 g |
| Ammonium bromide | 100 g |
| Glacial acetic acid | 50 g |
| Ammonium nitrate | 40 g |

Made up to 1 liter by adding water, and adjusted to pH 3.4 using ammonia water or glacial acetic acid.

| Bleaching replenishing solution | |
|---|---|
| Ferric ammonium 1,3-propylenediaminetetraacetate | 0.17 mol |
| 1,3-Propylenediaminetetraacetate | 7 g |
| Ammonium bromide | 142 g |
| Glacial acetic acid | 70 g |
| Ammonium nitrate | 57 g |

Made up to 1 liter by adding water, and adjusted to pH 3.4 using ammonia water or glacial acetic acid.

| Fixing solution | |
|---|---|
| Ammonium thiosulfate | 150 g |
| Anhydrous sodium bisulfite | 20 g |
| Sodium metabisulfite | 40 g |

Made up to 1 liter by adding water, and adjusted to pH 6.5 using glacial acetic acid or ammonia water.

Stabilizing Solution and Stabilizing Replenishing Solution

The same as those in Example 2.

As a result of the above experiments, substantially the same results were obtained in respect of fading rate and yellow stain.

As described above, the present invention can provide a stabilizing solution for light-sensitive silver halide color photographic materials, and a processing method, that can prevent discoloration of dyes in an environment of low humidity even when no formaldehyde is contained in the stabilizing solution, can keep stable dye images without regard to variation in processing quantity, and also do not tend to cause sulfiding.

What is claimed is:

1. A stabilizing solution for a light-sensitive silver halide color photographic material which comprises a compound represented by the following Formula F, and has a pH of from 7.5 to 10.0;

Formula F:

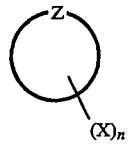

wherein Z represents a group of atoms necessary to form a substituted or unsubstituted cyclic hydrocarbon, X represents an aldehyde group,

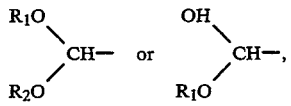

wherein $R_1$ and $R_2$ each represent a lower alkyl group; and n is an integer of 1 to 3.

2. The solution of claim 1, wherein Z represents a group of atoms necessary to form a substituted cyclic hydrocarbon.

3. The solution of claim 1, wherein said stabilizing solution for a light-sensitive silver halide color photographic material comprises substantially no formaldehyde.

4. The solution of claim 1, wherein said stabilizing solution for a light-sensitive silver halide color photographic material comprises a water-soluble surface active agent and an amount of a water-soluble surface active agent is within the range of 0.1 to 40 g.

5. The solution of claim 1, wherein said stabilizing solution for a light-sensitive silver halide color photographic material comprises a anti fungal agent.

6. The solution of claim 1, wherein said compound represented by Formula F, is a compound selected from the group consisting of No. 1 to No. 48, and Structural formulas of Exemplary compounds 1 to 48 are each completed by inserting the following substituents or atoms 1 to 6 to the positions 1 to 6 of the following formula;

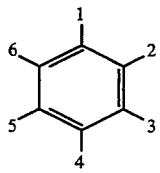

| No. | 1 | 2 | 3 | 4 | 5 | 6 |
|---|---|---|---|---|---|---|
| 1 | CHO | H | H | H | H | H |
| 2 | CHO | H | H | OH | H | H |
| 3 | CHO | H | OH | H | H | H |
| 4 | CHO | OH | H | H | H | H |
| 5 | CHO | OH | H | OH | H | H |
| 6 | CHO | H | OH | H | OH | H |
| 7 | CHO | OH | OH | H | H | H |

-continued

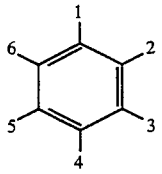

| No. | 1 | 2 | 3 | 4 | 5 | 6 |
|---|---|---|---|---|---|---|
| 8 | CHO | H | CHO | H | OH | H |
| 9 | CHO | H | CHO | H | H | OH |
| 10 | CHO | OH | CHO | H | H | H |
| 11 | CHO | H | CHO | H | CHO | H |
| 12 | CHO | OH | CHO | H | CHO | H |
| 13 | $CH(OCH_3)_2$ | H | OH | H | H | H |
| 14 | $CH(OCH_3)_2$ | H | H | OH | H | H |
| 15 | $CH(OCH_3)_2$ | H | OH | H | OH | H |
| 16 | CHO | H | $NO_2$ | H | H | H |
| 17 | CHO | H | H | $NO_2$ | H | H |
| 18 | CHO | $NO_2$ | H | H | H | H |
| 19 | CHO | H | $NO_2$ | H | $NO_2$ | H |
| 20 | CHO | H | H | $OCH_3$ | H | H |
| 21 | CHO | H | $OCH_3$ | H | OH | H |
| 22 | CHO | H | OH | $OCH_3$ | H | H |
| 23 | CHO | H | $OCH_3$ | OH | H | H |
| 24 | CHO | H | OH | $OCH_3$ | OH | H |
| 25 | CHO | H | Cl | H | H | H |
| 26 | CHO | H | H | Cl | H | H |
| 27 | CHO | H | Cl | H | Cl | H |
| 28 | CHO | H | COOH | COOH | H | H |
| 29 | CHO | H | Br | H | H | H |
| 30 | CHO | H | H | Br | H | H |
| 31 | CHO | H | OH | $SO_3H$ | H | H |
| 32 | CHO | H | H | $NH_2$ | H | H |
| 33 | CHO | H | H | $N(CH_3)_2$ | H | H |
| 34 | CHO | H | H | $N(C_2H_6)_2$ | H | H |
| 35 | CHO | H | H | $CONH_2$ | H | H |
| 36 | CHO | H | H | $SO_2NH_2$ | H | H |
| 37 | CHO | H | H | $SO_3H$ | H | H |
| 38 | CHO | H | H | CN | H | H |
| 39 | CHO | H | H | $COOCH_3$ | H | H |
| 40 | CHO | H | H | COOH | H | H |
| 41 | CHO | H | $SO_3H$ | H | H | H |
| 42 | CHO | H | COOH | H | H | H |
| 43 | CHO | H | CN | H | H | H |
| 44 | CHO | H | $COOCH_3$ | H | H | H |
| 45 | CHO | H | $CONH_2$ | H | H | H |
| 46 | $CH(OH)(OCH_3)$ | H | OH | H | H | H |
| 47 | $CH(OH)(OCH_3)$ | H | H | OH | H | H |
| 48 | CHO | H | OH | $CH_3$ | H | H |

7. The solution of claim 4, wherein said water-soluble surface active agent is a member selected from the group consisting of Formula SI, SII, and SU-I; Formula SI:

$$R^1—X—(E^1)_{l1}—(E^2)_{m1}—(E^3)_{n1}—R^2$$

wherein $R^1$ represents a hydrogen atom, an aliphatic group or an acyl group, $R^2$ represents a hydrogen atom or an aliphatic group, $E^1$ represents an ethylene oxide group, $E^2$ represents a propylene oxide group, $E^3$ represents an ethylene oxide group, X represents an oxygen atom or an $—R^3N—$ group, wherein $R^3$ represents an aliphatic group, a hydrogen atom or $(E^1)_{12}—(E^2)_{m2}—(E^3)_{n2}—R^4$, wherein $R^4$ represents a hydrogen atom or an aliphatic group, $l_1$, $l_2$, $m_1$, $m_2$, $n_1$, $n_2$ each represents a value of 0 to 300; Formula SII:

$$A_2—O—(B)_m—(C)_n—X^1$$

wherein $A_2$ represents a monovalent organic group as exemplified by an alkyl group having 6 to 50 carbon atoms, B and C represents each an ethylene oxide group, a propylene oxide group, or $$—(CH_2)_{n1}—(CH)_{m1}(OH)—(CH_2)_{l1}—O—,$$

wherein n1, m1 and 11 each represents 0, 1, 2 or 3, m and n each represents an integer of 0 to 100, $X^1$ represents a hydrogen atom, or an alkyl group, an aralkyl group or an aryl group,

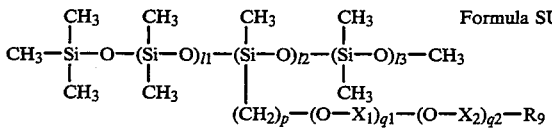

Formula SU-I wherein $R_9$ represents a hydrogen atom, a hydroxyl group, a lower alkyl group, an alkoxy group,

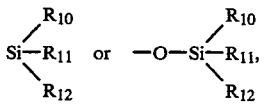

wherein $R_1$, $R_{11}$ and $R_{12}$ each represents a hydrogen atom or a lower alkyl group, and $R_1$, $R_{11}$ and $R_{12}$ are the same or different from each other, $l_1$, to $l_3$ each represents an integer of 0 or 1 to 30, p, q1 and q2 each represents an integer of 0 or 1 to 30, $X_1$ and $X_2$ each represent $—CH_2CH_2—$, $—CH_2CH_2CH_2—$,

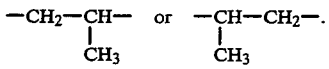

8. The solution of claim 5, wherein said antifungal agent is a member selected from the group consisting of Formula B-1, B-2, and B-3,

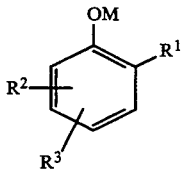

Formula B-1 wherein $R_1$ represents an alkyl group, a cycloalkyl group, an aryl group, a hydroxyl group, an alkoxycarbonyl group, an amino group, a carboxyl group (including its salt) or a sulfo group (including its salt);

$R^2$ and $R^3$ independently represent a hydrogen atom, a halogen atom, an amino group, a nitro group, a hydroxyl group, an alkoxycarbonyl group, a carboxyl group (including its salt) or a sulfo group (including its salt), M represents a hydrogen atom, an alkali metal or an ammonium group;

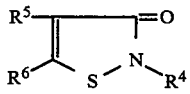

Formula B-2

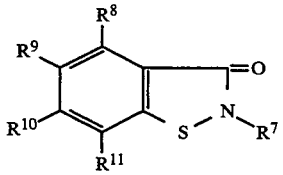

Formula B-3 wherein $R^4$ represents a halogen atom, an alkyl group, an aryl group, a halogenated alkyl group, $—R^{12}—OR^{13}$, $—CONHR^{14}$ (where $R^{12}$ represents a alkylene group, $R_{13}$ and $R_{14}$ each represent a hydrogen atom, an alkyl group or an arylalkyl group) or an arylalkyl group; $R^5$ and $R^6$ each represent a hydrogen atom, a halogen atom, a halogenated alkyl group or alkyl group; R7 represents a hydrogen atom, a halogen atom, an alkyl group, an aryl group, a halogenated alkyl group, an arylalkyl group, $—R^{15}—OR^{16}$, $—CONHR^{17}$ (where $R^{15}$ represents a alkylene group, $R_{16}$ and $R_{17}$ each represent a hydrogen atom, an alkyl group); and $R_8$, $R_9$, $R_{10}$ and $R_{11}$ each represent a hydrogen atom, a halogen atom, a hydroxyl group, an alkyl group, an amino group or a nitro group.

9. The solution of claim 1, wherein a processing method of said material comprising the steps of:

processing with a processing solution having a bleaching ability;

processing with a processing solution having a fixing ability;

processing with said stabilizing solution.

10. The solution of claim 1, wherein a processing method of said material comprising the steps of:

processing with a processing solution having a fixing ability;

processing with said stabilizing solution.

* * * * *